US006941096B2

(12) United States Patent
Matsuda et al.

(10) Patent No.: US 6,941,096 B2
(45) Date of Patent: Sep. 6, 2005

(54) BELT DRIVE CONTROL DEVICE AND IMAGE FORMING APPARATUS INCLUDING THE SAME

(75) Inventors: Hiromichi Matsuda, Kanagawa (JP); Hiroshi Koide, Kanagawa (JP); Toshiyuki Andoh, Kanagawa (JP); Makoto Komatsu, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 27 days.

(21) Appl. No.: 10/634,783

(22) Filed: Aug. 6, 2003

(65) Prior Publication Data

US 2004/0086299 A1 May 6, 2004

(30) Foreign Application Priority Data

Aug. 7, 2002 (JP) ..... 2002-230537
Jul. 15, 2003 (JP) ..... 2003-197185

(51) Int. Cl.[7] ..... G03G 15/02; G03G 15/16

(52) U.S. Cl. ..... 399/167; 399/162; 399/312; 399/313

(58) Field of Search ..... 399/167, 162, 399/164, 312, 313, 303

(56) References Cited

U.S. PATENT DOCUMENTS 4,566,779 A * 1/1986 Coli et al.
5,202,733 A * 4/1993 Hediger et al. ..... 399/303
5,210,573 A * 5/1993 Fukuchi et al.

(Continued)

FOREIGN PATENT DOCUMENTS

JP 10-78734 3/1998
JP 10-186787 7/1998
JP 2000330353 A * 11/2000 ..... G03G/15/01
JP 2000-356875 12/2000

OTHER PUBLICATIONS

U.S. Appl. No. 10/198,091, filed Jul. 19, 2002, Koide.
U.S. Appl. No. 10/370,526, filed Feb. 24, 2003, Hirai et al.
U.S. Appl. No. 09/985,741, filed Nov. 6, 2001, Koide.
U.S. Appl. No. 10/054,993, filed Jan. 25, 2002, Seto et al.
U.S. Appl. No. 10/198,658, filed Jul. 18, 2002, Koide.
U.S. Appl. No. 10/308,062, filed Dec. 3, 2002, Koide.
U.S. Appl. No. 10/387,506, filed Mar. 14, 2003, Koide et al.
U.S. Appl. No. 10/893,391, filed Jul. 19, 2004, Yokoyama et al.
U.S. Appl. No. 10/937,447, filed Sep. 10, 2004, Komatsu et al.

*Primary Examiner*—Susan Lee
(74) *Attorney, Agent, or Firm*—Oblon, Spivak, McClelland, Maier & Neustadt, P.C.

(57) ABSTRACT

A belt drive control device constructed to sense the angular displacement or the angular velocity of a driven roller. The belt drive control device separates, from a sensed angular displacement or the angular velocity, an AC component having a frequency that corresponds to the periodic thickness variation of an endless belt in the circumferential direction, and then controls the rotation of a drive roller in accordance with the amplitude and phase of the AC component.

92 Claims, 17 Drawing Sheets

U.S. PATENT DOCUMENTS 5,421,255 A * 6/1995 Kryk ..... 399/162
5,528,343 A * 6/1996 Tada et al. ..... 399/167
5,638,354 A 6/1997 Nakayama et al.
5,737,307 A 4/1998 Shimizu
5,778,287 A * 7/1998 Yu ..... 399/167
5,790,511 A 8/1998 Juso et al.
5,797,069 A * 8/1998 Kimura et al.
5,812,520 A 9/1998 Nakayama et al.
5,822,286 A 10/1998 Nakayama et al.
6,031,633 A 2/2000 Andoh et al.
6,301,457 B1 * 10/2001 Chadani et al. ..... 399/167
6,343,053 B1 1/2002 Akanuma et al.
6,385,419 B1 * 5/2002 Genovese ..... 399/167
6,445,656 B1 9/2002 Koide
6,448,997 B1 9/2002 Koide
6,463,234 B2 * 10/2002 Arimitsu et al. ..... 399/167
6,487,149 B1 11/2002 Yokoi et al.
6,507,713 B2 1/2003 Koide
6,545,958 B1 4/2003 Hirai et al.
2002/0003755 A1 1/2002 Fujita et al.
2002/0181362 A1 12/2002 Koide
2003/0151999 A1 8/2003 Hirai et al.

* cited by examiner $C^2=A^2+B^2-2AB\cos(a-b)$ $B/\sin c=C/\sin(a-b)$ $X=C\sin(a+c)$

BELT DRIVE CONTROL DEVICE AND IMAGE FORMING APPARATUS INCLUDING THE SAME

BACKGROUND OF THE INVENTION

1. Field of the Invention

The present invention relates to a method and an apparatus for controlling the rotation of one of a plurality of rotary support bodies supporting an endless belt and to which drive torque is transferred, and an image forming apparatus including the same.

2. Description of the Background Art

An electrophotographic image forming apparatus of the type including a photoconductive belt, intermediate image transfer belt, sheet conveying belt or similar endless belt is conventional. The prerequisite with this type of image forming apparatus is that the drive of the belt should be accurately controlled in order to insure high image quality. Particularly, in a tandem, color image forming apparatus feasible for a high speed, small size configuration, a belt for conveying a sheet or recording medium must be driven with high accuracy. More specifically, in a tandem, color image forming apparatus, and endless belt conveys a sheet via a plurality of image forming units arranged side by side in the direction of conveyance and assigned to different colors. In this condition, toner images of different colors are sequentially transferred to the sheet one above the other, completing a color image.

In a specific configuration of the tandem, color image forming apparatus, a yellow, a magenta, a cyan and a black image forming unit are sequentially arranged in this order in the direction of sheet conveyance. The yellow to black image forming units each develop a toner image formed on a particular photoconductive drum by a laser scanning unit, thereby forming a toner image. Such toner images are sequentially transferred one above the other to a sheet being conveyed by a belt while being electrostatically retained on the belt, completing a color image. Subsequently, a fixing unit fixes the color image on the sheet with heat and pressure.

The above belt is passed over a drive roller and a driven roller, which are parallel to each other, while being subject to adequate tension. The drive roller is driven by a motor at preselected speed and causes the belt to turn at preselected speed. The sheet is conveyed to the image forming unit side of the belt by a sheet feed mechanism at preselected timing. The sheet is then conveyed via the consecutive image forming units at the same speed as the belt.

In the tandem, color image forming apparatus of the type described, it is extremely important to cause the a sheet, i.e., the belt to move at preselected speed, so that the toner images of different colors can be superposed on the sheet in accurate register.

To accurately control the drive of any one of different kinds of endless belts mentioned earlier, it is a common practice to cause the drive roller to rotate at constant speed by maintaining the angular velocity of the motor or that of a gear meshing with the drive roller constant. This control scheme, however, cannot maintain the belt speed constant if the thickness of the belt is not constant, particularly in the direction in which the belt moves.

To solve the above problem, Japanese Patent No. 2,639,106, for example, proposes to control the rotation speed of a drive roller by measuring the thickness of a belt beforehand and then calculating the parameter of a drive source, which is necessary for maintaining the belt speed constant, on the basis of the thickness. However, this scheme is difficult to practice because it is extremely difficult to measure the fine thickness of a belt. Further, although no extra part cost is required, measured data must be input in the apparatus on the production line or the market, increasing production cost and service cost.

Japanese Patent Laid-Open Publication No. 2001-228777 proposes to correct the rotation speed of a drive roller while measuring the thickness of a belt or to record the thickness variation of the belt over one turn and then correct the above rotation speed on the basis of the thickness variation. This proposal, however, has a problem that it is extremely difficult to effect real-time measurement of fine belt thickness and a problem that production cost increases because an expensive sensor, for example, is necessary for enhancing sensitivity.

Further, Japanese Patent Laid-Open Publication No. 2000-310897 teaches a control scheme pertaining to a belt formed by centrifugal molding and apt to vary in thickness over one turn in the form of a sinusoidal wave. In accordance with this control scheme, before the belt is mounted to an apparatus body, the thickness profile or irregularity of the belt is measured over the entire circumference on the production line and written to a ROM (Read Only Memory). Subsequently, a reference mark representative of a home position is provided on the belt at a position where the thickness profile over the entire circumference appears in the same phase. By detecting the reference mark of the belt, it is possible to control belt drive means in such a manner as to cancel the speed variation of the belt ascribable to thickness variation. However, this control scheme is not practicable without noticeably increasing cost necessary for the production of the belt.

Japanese Patent Laid-Open Publication No. 22-174932 teaches that by storing a relation between a control target and errors occurred during past operation and then correcting the control target, it is possible to maintain the movement of a belt more stable against thickness variation (see paragraph 0034). This document, however, does not describe the correction of the control target or control specifically.

SUMMARY OF THE INVENTION

It is an object of the present invention to provide a belt drive control method capable of maintaining the moving speed of a belt constant without regard to the thickness variation of the belt while preventing cost from increasing, and an image forming apparatus including the same.

It is another object of the present invention to provide a process cartridge, a program, and a recording medium implementing such control over belt drive.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

To better understand the present invention, a relation between the thickness and the running speed of an endless belt will be described first.

Figure 1:
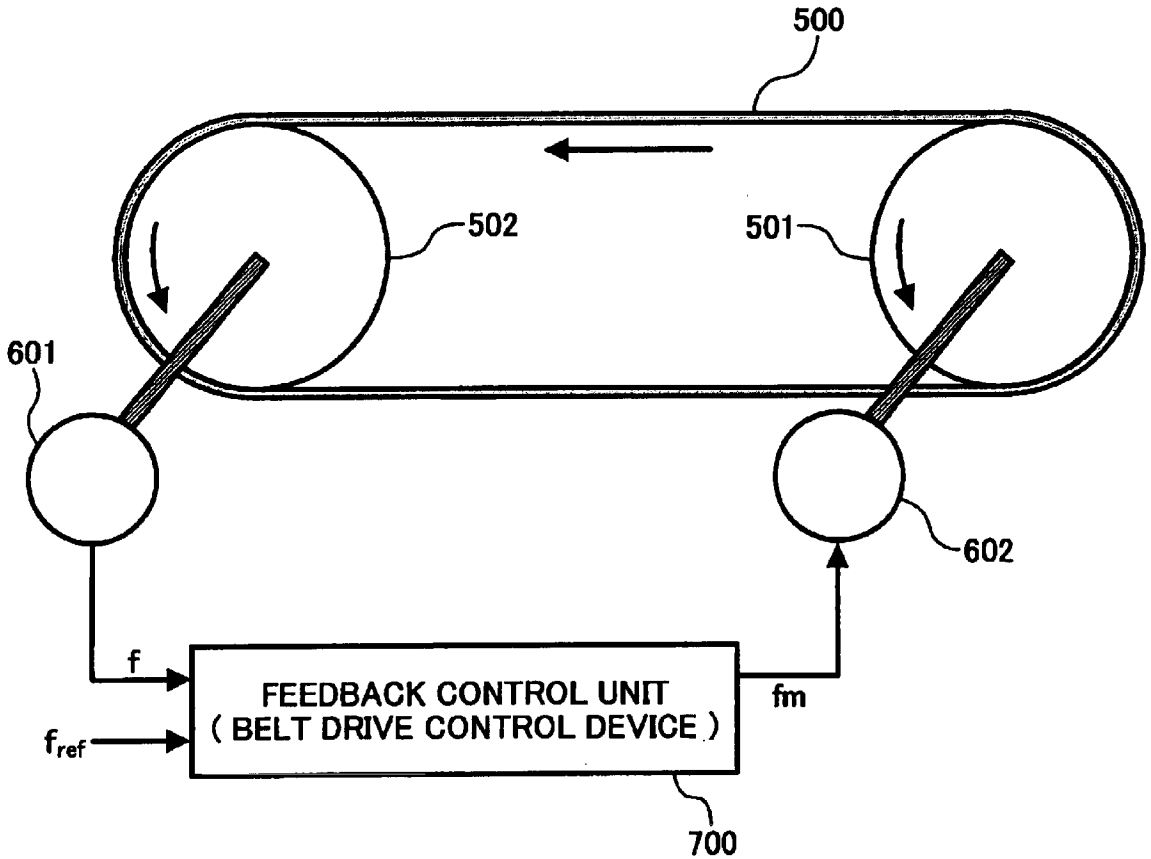
FIG. 1 shows a feedback control system for a belt for describing a relation between belt thickness and belt speed.

FIG. 1 shows a feedback control system for controlling an endless belt. As shown, an endless belt 500 is passed over a drive roller or drive rotary support body and a driven roller or driven rotary support body 502. Assume that the thickness of the belt 500 has only a first-order variation component (one turn of the belt 500 is one period). A feedback control unit 700 controls the movement of the belt 500 by feedback control. For example, assuming that a PLL (Phase Locked Loop) system has a reference frequency $f_{ref}$ and that an encoder 601 outputs a sensed frequency f, then the feedback control unit 700 controls a motor 602 such that the following relation holds:

$$f-f_{ref}=0$$

In the above feedback control, the driven roller 502 rotates at a constant speed ωo. The influence of the thickness of the belt 500 under such conditions will be described on the assumption of the following model.

Figure 2A:
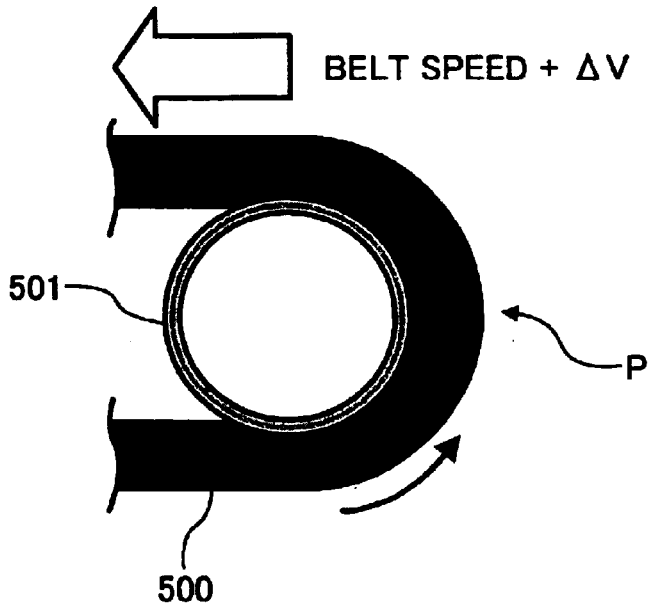
FIGS. 2A and 2B show the relation of FIG. 1 more specifically.
Figure 2B:
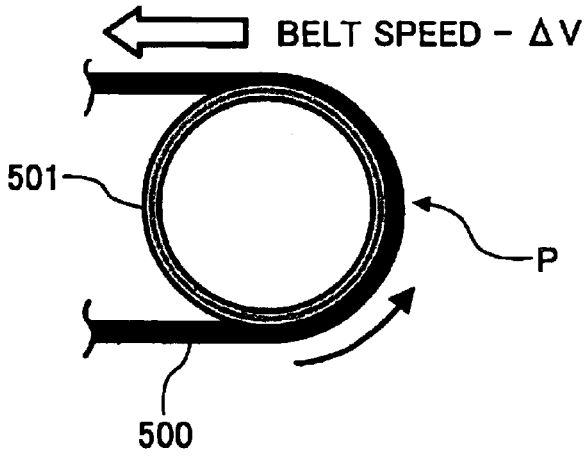

FIGS. 2A and 2B show a relation between the thickness and the speed of the belt 500. Assume that the drive roller 501 is rotating at a reference angular velocity. Then, as shown in FIG. 2A, when part of the belt 500 thicker than the other part is moved by the drive roller 501, the belt speed increases. Conversely, as shown in FIG. 2B, the belt speed decreases when thinner part of the belt 500 is moved by the drive roller 501. Assuming that the thickness of the belt 500 varies sinusoidally in the circumferential direction, it may be practical to consider that the belt speed and roller speed are determined at the center P of the angle over which the belt 500 wraps around the drive roller 501. In this respect, assume that the drive roller 501 and driven roller 502 have the same radius R, and that the belt 500 has, when wrapped around the roller 501 or 502, an effective thickness at the center in the direction of thickness. Then, the effective thickness, which relates to the belt speed, at the driven roller 502 side is ΔRe which is expressed as:

$$\Delta Re=\Delta Ro+r\cdot\sin(\omega_b t+\alpha) \tag{1}$$

where ΔRo denotes a mean thickness, r denotes the amplitude of the thickness variation, ωb denotes the angular velocity of the belt 500, and α denotes the phase angle of the thickness variation, which is assumed to be zero.

As for the drive motor 602, the variation phase of the belt thickness is shifted by n, so that an effective thickness ΔRm is expressed as:

$$\Delta Rm=\Delta Ro+r\cdot\sin(\omega_b t-\pi)=\Delta Ro-r\cdot\sin\omega_b t \tag{2}$$

Therefore, a belt speed v is produced by:

$$v=(R+\Delta Ro+r\cdot\sin\omega_b t)\omega o \tag{3}$$

where ωo denotes the angular velocity of the driven roller 502 with which the encoder 601 is associated. Here, the following relation holds:

$$(R+\Delta Ro-r\cdot\sin\omega_b t)\omega m=v=(R+\Delta Ro+r\cdot\sin_b t)\omega o$$

It follows that the angular velocity ωm of the motor 602 is expressed as;

$$\begin{aligned}\omega m &= (R+\Delta Ro+r\cdot\sin\omega_b t)\omega o/(R+\Delta Ro-r\cdot\sin\omega_b t) \\ &= [1+\{2r/(R+\Delta Ro)\}\cdot\sin\omega_b t]\omega o\end{aligned} \tag{4}$$

Conversely, when the drive motor 602 is rotated at the constant angular velocity ωo, the angular velocity ωe of the driven roller 502 is also expressed as:

$$\omega e=[1+\{2r/(R+\Delta Ro)\}\cdot\sin\omega_b t]\omega o \tag{5}$$

Therefore, the above control fails to prevent the belt speed from varying. However, because feedback is effected via the encoder 601 associated with the driven roller 502, the influence of slip of the drive roller 501 is canceled so long as the driven roller 502 and belt 500 do not slip on each other.

Figure 3A:
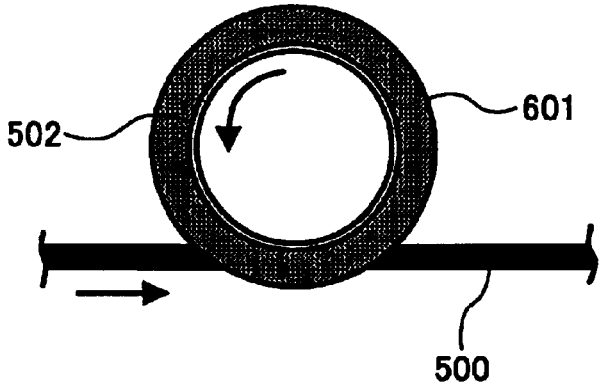
FIGS. 3A and 3B each show a particular condition wherein a belt wraps around a driven roller.
Figure 3B:
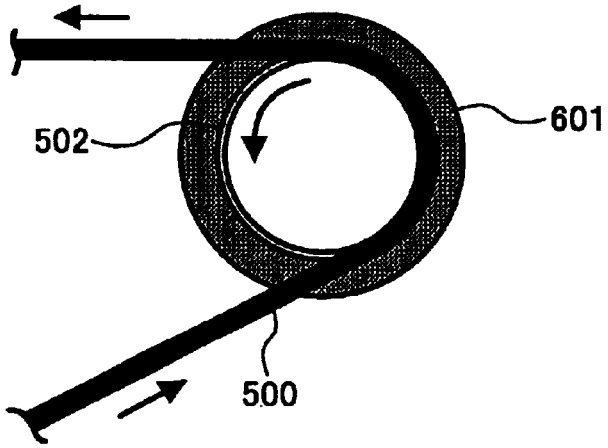

As for a relation between the wrapping angle and the running speed of the belt 500, the smaller the wrapping angle, the less the influence of the belt thickness on the angular velocity of the roller 501 or 502. For example, as shown in FIG. 3A, when the belt 500 makes point-to-point contact with the driven roller 502, the angular velocity of the driven roller 502 is determined without being influenced by the belt thickness. In this condition, however, the driven roller 502 is apt to slip on the belt 500, so that the encoder 601 cannot accurately sense the angular velocity of the driven roller 502. On the other hand, when the belt 500 wraps around the driven roller 502 in the condition shown in FIG. 3B, the angular velocity of the driven roller 502 varies in accordance with the thickness of part of the belt 500 contacting the driven roller 502.

Figure 4:
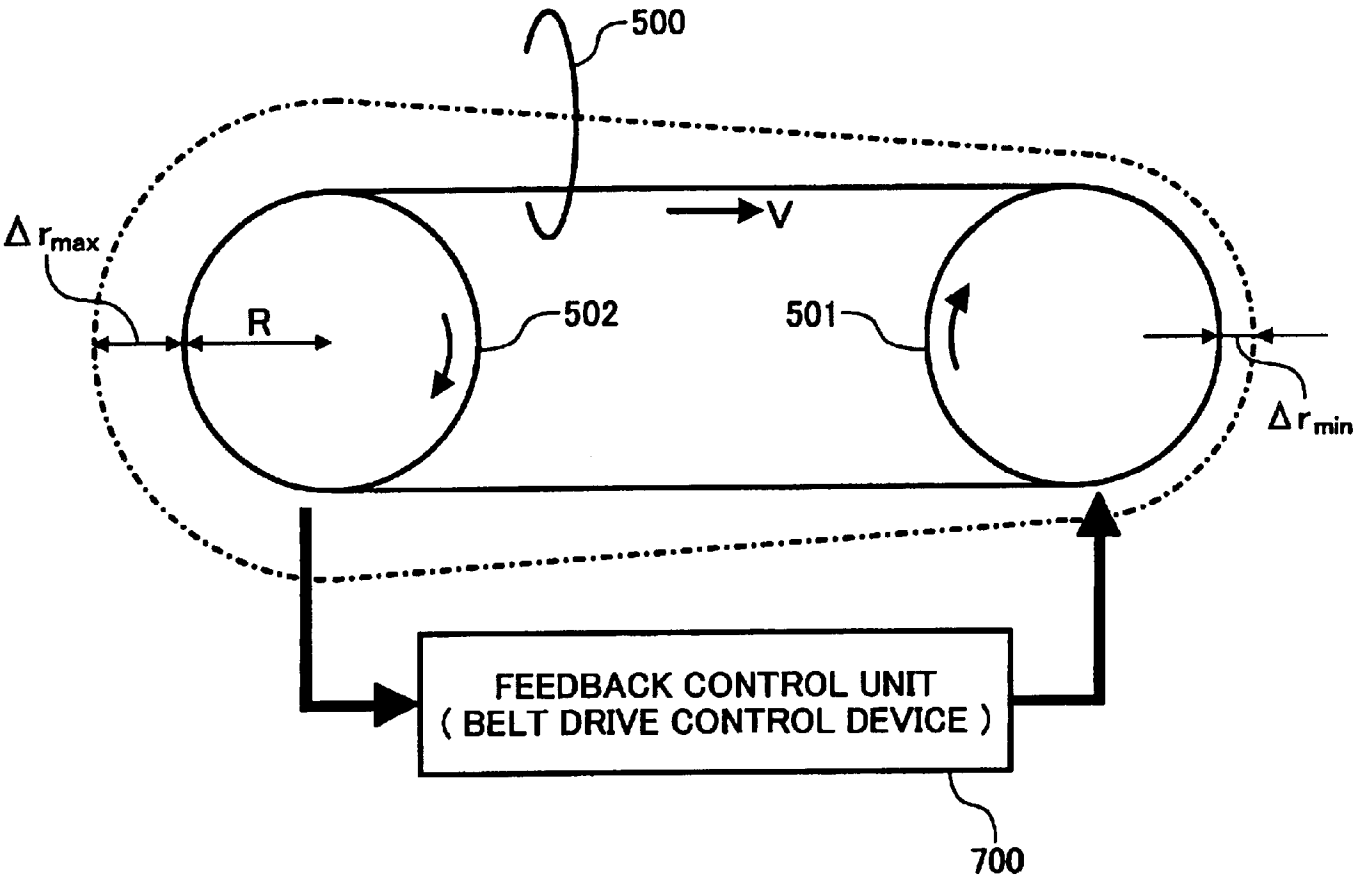
FIG. 4 is a view demonstrating the principle of a belt drive control method of the present invention.

Reference will be made to FIG. 4 for describing the principle of belt drive control unique to the present invention. As shown, in accordance with the present invention, the angular velocity of the drive roller 501 driven by the motor or drive source and that of the driven roller 502 provided with the encoder are selectively varied. More specifically, when the belt speed v is constant, the angular velocity of the roller 501 or 502 around which the thickest part of the belt 500 is wrapped is lowered.

In FIG. 4, taking account of the periodic variation of the belt thickness (first-order component), a dash-and-dot line indicates the position of the effective thickness mentioned earlier that determines the effective belt speed. Assuming that the belt 500 is running at a constant speed V in the condition shown in FIG. 4, then the angular velocity $\omega_L$ of the driven roller 502 positioned at the left-hand side is expressed as:

$$\omega_L = V/(R+\Delta r_{max}) \tag{6}$$

where $\Delta r_{max}$ denotes the maximum distance between the position of the effective thickness and the roller contact position of the belt 500, i.e., the maximum effective thickness.

On the other hand, the angular velocity $\omega_R$ of the drive roller 501 positioned at the right-hand side is expressed as:

$$\omega_R = V/(R+\Delta r_{min}) \tag{7}$$

where $\Delta r_{min}$ denotes the minimum distance between the position of the effective thickness and the roller contact position of the belt 500, i.e., the minimum effective thickness.

The mean angular velocity ωo of each roller 501 or 502 is produced by:

$$\omega o = V/\{R+(\Delta r_{max}+\Delta r_{min})/2\} \tag{8}$$

In FIG. 4, if the encoder is mounted on the shaft of the driven roller 502 and if a driveline, including the motor and gears, is connected to the drive roller 501 and subject to feedback control, then the belt 500 moves at the speed V. When the belt 500 is located at the position shown in FIG. 4, the speed $\omega_L$ sensed by the encoder is $V/(R+\Delta r_{max})$ which is lower than the mean rotation speed or target rotation speed. In this case, the feedback control unit 700 drives the motor in such a manner as to increase the rotation speed of the drive roller 501. If the rotation speed $\omega_R$ of the drive roller 501 can be tuned to $V/(R+\Delta r_{min})$, then the belt moves at the constant speed V without regard to the periodic variation of its thickness.

Figure 5:
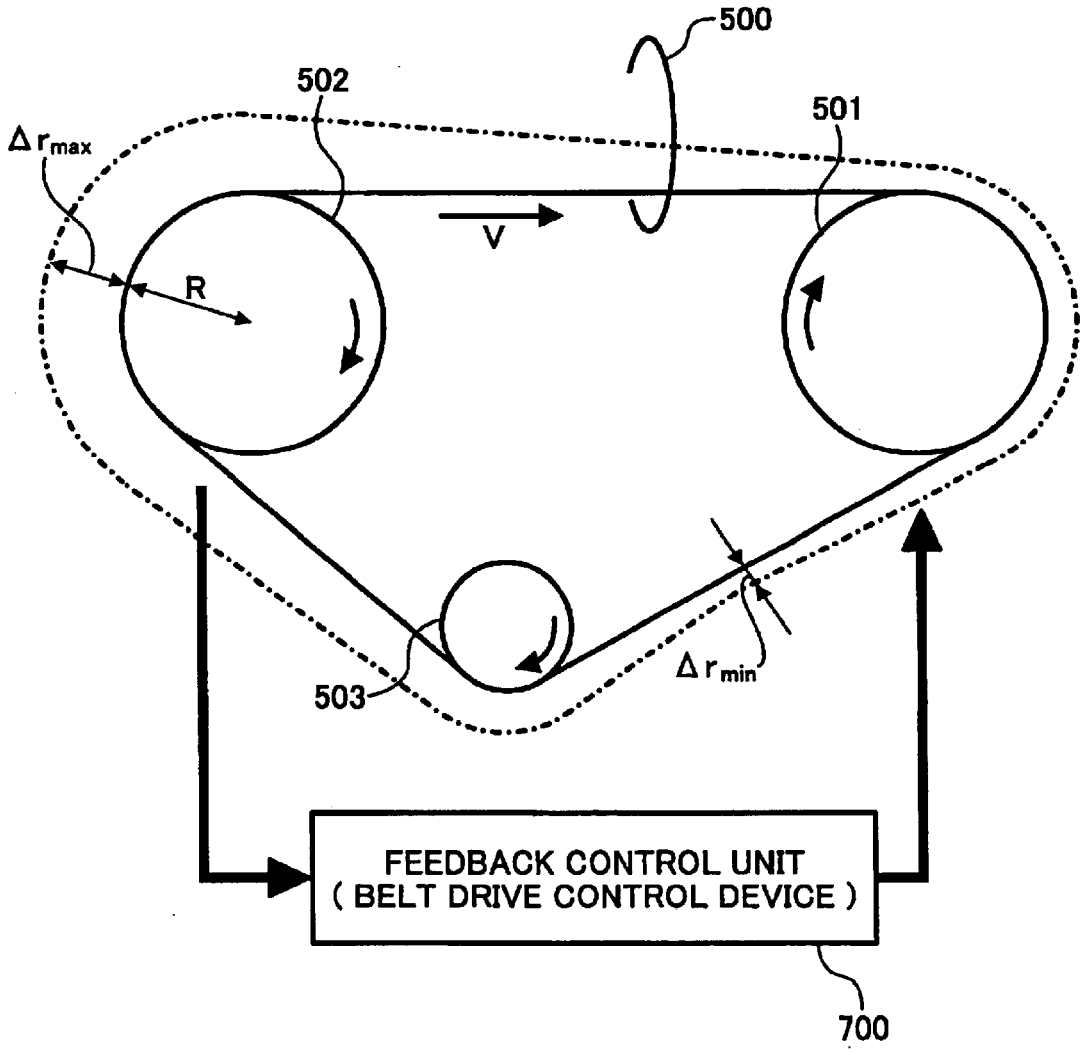
FIG. 5 shows a generalized model of the belt drive control method of the present invention.

Referring to FIG. 5, the generalized model of the belt drive control method of the present invention will be described. As shown, the belt 500 has periodic thickness variation, including higher-order periodic variations), in the circumferential direction and is passed over three rollers 501 through 503 to move at the constant speed V. A phase shift ϕ between the rotation variation of the driven roller 502 and that of the drive roller 501 ascribable to the thickness variation of the belt 500 is not one-half (π) of the period of thickness variation. The feedback control unit 700 therefore has to effect feedback control to vary the angular velocity of the drive roller 501 by taking account of the phase shift ϕ. It is also necessary to set the optimum amount of feedback, e.g., the optimum gain that makes the belt speed constant.

The method of the present invention corrects the variation components of belt thickness with the following principle. Assume that the variation of belt thickness is the composite of frequency components that sinuoidally vary, and that belt speed and roller rotation speed are determined at the center of the angle over which the belt 500 wraps around the roller.

The influence of belt thickness on belt speed varies in accordance with the above wrapping angle, the material of the belt 500, tension acting on the belt 500 and so forth. More specifically, when an apparatus is implemented with a mechanical layout configured to vary the wrapping angle, it is necessary to consider that the influence of belt thickness on belt speed differs from the drive roller 501 to the driven roller 502. Therefore, processing to be described hereinafter is required.

In the generalized model concerned, the following parameters are used:

T: one rotation period of belt $T_N$: N-th order variation period T/N (N being a natural number) of belt thickness The following belt thickness is represented by a position in the direction of belt thickness relating to the effective moving speed:

$B_{tN}$: maximum amplitude of belt N-th order variation component $B_{to}$: belt mean thickness $B_t$: belt thickness $B_t = B_{to} + B_{tN} \cdot \sin(\omega_N t + \alpha_N)$ $\omega_N = 2n/T_N$ $\alpha_N$: N-th order variation phase angle of belt when t is zero V: belt speed $R_E$: radius of driven roller provided with encoder $R_D$: radius of driven roller provided with driveline $\omega_\Sigma$: driven roller angular speed when belt speed is V $\omega_D$: drive roller angular speed when belt speed is V Further, there are defined a coefficient β at the drive side and a coefficient κ at the encoder side as coefficients with which belt thickness variation influences belt speed in accordance with the wrapping angle, material and so forth of the belt. Effective belt thickness, which is a reference for the moving speed of part of the belt 500 contacting the driven roller 502, can be expressed as $\kappa B_{to}$. Likewise, effective belt thickness, which is a reference for the moving speed of part of the belt 500 contacting the drive roller 501, can be expressed as $\beta B_{to}$.

By using the various parameters mentioned above, the angular velocity $\omega_E$ of the driven roller 502 and the angular velocity $\omega_D$ of the drive roller 501 are expressed as:

$$\begin{aligned}\omega_E &= V/(R_E+\kappa B_t) \\ &= V/\{(R_E+\kappa B_{to}+\kappa B_{tN}\cdot\sin(\omega_N t+\alpha_N)\} \\ &= \{V/(R_E+\kappa B_{to})\}((1-\{\kappa B_{tN}/(R_E+\kappa B_{to})\}\cdot\sin(\omega_N t+\alpha_N)) \\ &= \{V/(R_E+\kappa B_{to})\}-\{V\cdot\kappa/(R_E+\kappa B_{to})^2\}B_{tN}\cdot \\ &\quad \sin(\omega_N t+\alpha_N)\end{aligned} \tag{9}$$

$$\begin{aligned}\omega_D &= V/[R_D+\beta B_{to}+\beta B_{tN}\cdot\sin\{\omega_N(t-\tau)+\alpha_N\}] \\ &= \{V/(R_D+\beta B_{tn})\}-\{V\cdot\beta/(R_D+\beta B_{to})^2\}B_{tN}\cdot \\ &\quad \sin\{\omega_N(t-\tau)+\alpha_N\}\end{aligned} \tag{10}$$

Therefore, if the driven roller 502 is driven such that the equations (9) and (10) are satisfied at the same time, the belt speed V remains constant. The second member of each of the equations (9) and (10) is a member dependent on the thickness variation of the belt 500.

While the equations (9) and (10) are represented only by the N-th order, they may be generalized as follows:

$$\omega_E = \{V/(R_E+\kappa B_{to})\}-\{V\cdot\kappa/(R_E+\kappa B_{to})^2\}\Sigma B_{tN}\cdot\sin(\omega_N t+\alpha_N) \tag{11}$$

$$\omega_D = \{V/(R_D+\beta B_{to})\}-\{V\cdot\beta/(R_D+\beta B_{to})^2\}\Sigma B_{tN}\cdot\sin\{\omega_N(t-\tau)+\alpha_N\} \tag{12}$$

Specific examples of the feedback control based on the above principle will be described hereinafter.

[Control 1]

Control 1 is feedback control executed with a principle to be described hereinafter. A feedback signal used in Control 1 has a DC and an AC component having gains Gde and $G_N$, respectively, expressed as:

$$Gdc=\{V/(R_D+\beta B_{to})\}/\{V/(R_E+\kappa B_{to})\} \tag{13}$$

$$G_N=\{V\cdot\beta/(R_D+\beta B_{to})^2\}/\{V\cdot\kappa/(R_E+\kappa B_{to})^2\} \tag{14}$$
$$=(\beta/\kappa)(R_E+\kappa B_{to})^2/(R_D+\beta B_{to})^2$$

In the case where the periodic variation of belt thickness includes a plurality of variation frequency components, the variation frequency components are corrected one by one on the basis of the equation (14). Up to which variation frequency component should be corrected is dependent on target accuracy.

A reference signal ref with which the feedback signal for feedback control is to be compared is generated in consideration of the various parameters stated above by use of the following equation:

$$ref=\omega_D \tag{15}$$
$$=\{V/(R_D+\beta B_{to})\}-\{V\cdot\beta/(R_D+\beta B_{to})^2\}\Sigma B_{tN}\cdot\sin\{\omega_N(t-\tau)+\alpha_N\}$$

Further, a feedback signal $\omega P_{DN}$ is generated by processing, in consideration of the various parameters, the N-th frequency component which is the AC component of the belt variation relating to the angular velocity of the driven roller 502. More specifically, The amplitude of the above N-th frequency component is multiplied by $G_N=(\beta/\kappa)(R_E+B_{to})^2/(R_D+B_{to})^2$ while the phase of the N-th frequency component is delayed by $T\tau=T-\tau$, thereby generating a feedback signal $\omega p_{DN}$. The N-th frequency component $\omega p_{DN}$ of the feedback signal and the N-th frequency variation component (second member) $ref_N$ of the reference signal ref are compared.

Part of the belt 500 moving toward the drive roller 501 involves thickness variation whose phase is delayed by a period of time $\tau$ from thickness variation sensed by the encoder. To control such thickness variation with the encoder output, it is necessary to use a signal appeared a period of time $\tau$ before the encoder output. That is, there must be used a signal delayed by $T-\tau=T\tau$. Alternatively, the angular velocity of the driven roller 502 represented by the equation (11) may be input as the reference signal ref. However, the time delay of the thickness variation component at the driven roller side up to the drive roller side must be taken into account.

In the following description, it is assumed that the angular velocity of the drive roller 501 represented by the equation (12) is input as the reference signal ref.

The DC component of the angular velocity of the driven roller 502, i.e., the encoder output is multiplied by $Gdc=(R_E+\kappa B_{to})/(R_D+\beta B_{to})$ to thereby generate the DC component $\omega p_{Ddc}$ of the feedback signal. The DC component $\omega p_{Ddc}$ of the feed back signal and the DC component refdc of the reference signal ref are compared. Assume that a difference between the two signals thus compared is $\epsilon dc$. In the case where the reference belt speed V varies from one apparatus to another apparatus due to irregularity in the mean thickness $B_{to}$ of the belt 500, the DC component $\omega p_{Ddc}$ of the reference signal is varied. By using the amount by which the DC component $\omega p_{Ddc}$ is varied, the mean thickness $B_{to}$ of the belt 500 is corrected and then used to control the thickness variation component thereafter. The reference belt speed V may be measured and adjusted in, e.g., a factory.

To control the individual frequency components of belt thickness variation, the reference signal $ref_N$, which causes $B_{tN}$ and $\alpha_N$ to vary, and the feedback signal $\omega p_{DN}$ produced by multiplying the N-th frequency component of the belt variation and delaying it by $T-\tau$, as stated earlier, are compared. $B_{tN}$ and $\alpha_N$ that make the result of comparison $\epsilon N$ minimum are selected.

The variation of belt speed is minimum so long as it is controlled under the conditions stated above.

Because the procedure for determining the reference signal $ref_N$ determines a reference signal for correcting the thickness variation of the belt 500, the procedure must be executed in a stable condition not susceptible to the load variation or the load of the belt driveline. For this purpose, in an image forming apparatus, for example, an image transferring unit is released at a position where a photoconductive drum and a sheet conveying belt contact each other. In an image forming apparatus including an intermediate image transfer belt, an image transfer roller is released without a sheet being conveyed to a secondary image transfer position while a cleaner is released from the intermediate image transfer belt.

Figure 6:
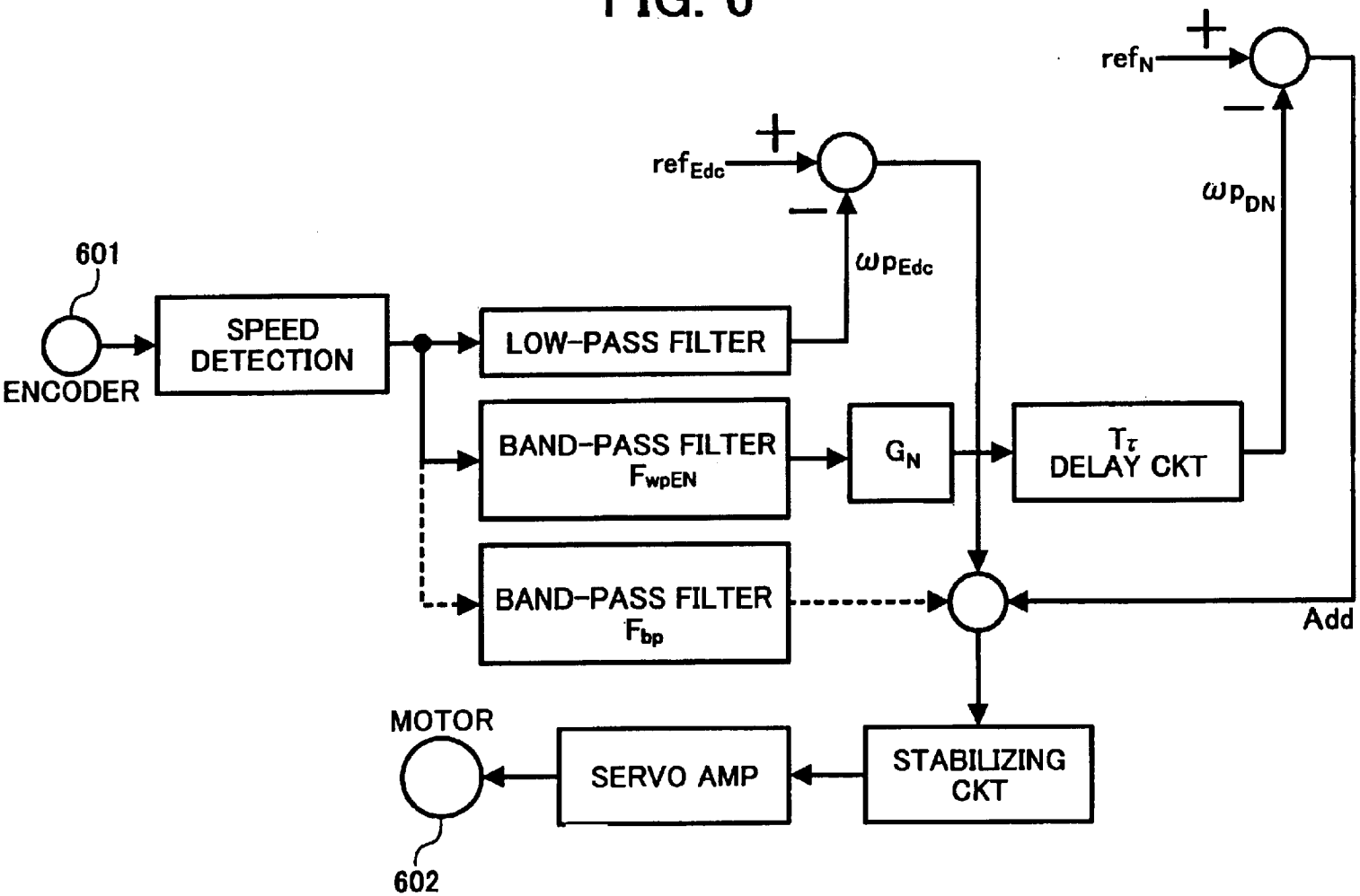
FIG. 6 is a schematic block diagram showing specific control means for executing the belt drive control method of the present invention.

FIG. 6 shows control means included in the feedback control unit 700 for executing Control 1. As shown, because a time delay does not have to be taken into account when it comes to a DC component, use is made of a reference signal $ref_E dc$ that can be directly compared with a velocity signal $\omega P_{Edc}$ output from the encoder. Band-pass filters $F\omega p_{EN}$, corresponding in number to frequency components to be controlled, are arranged in parallel. A band-pass filter $F_{bp}$ passes a high-frequency variation component to be controlled other than the thickness variation components, e.g., a variation ascribable to the eccentricity of the roller. In FIG. 6, circuit components other than a servo amplifier may be implemented by digital signal processing.

A low-pass filter shown in FIG. 6 may be replaced with band cut-off filters complementary in characteristic to the band-pass filters $F\omega p_{EN}$, in which case the band-pass filter $F_{bp}$ is omissible.

Figure 7:
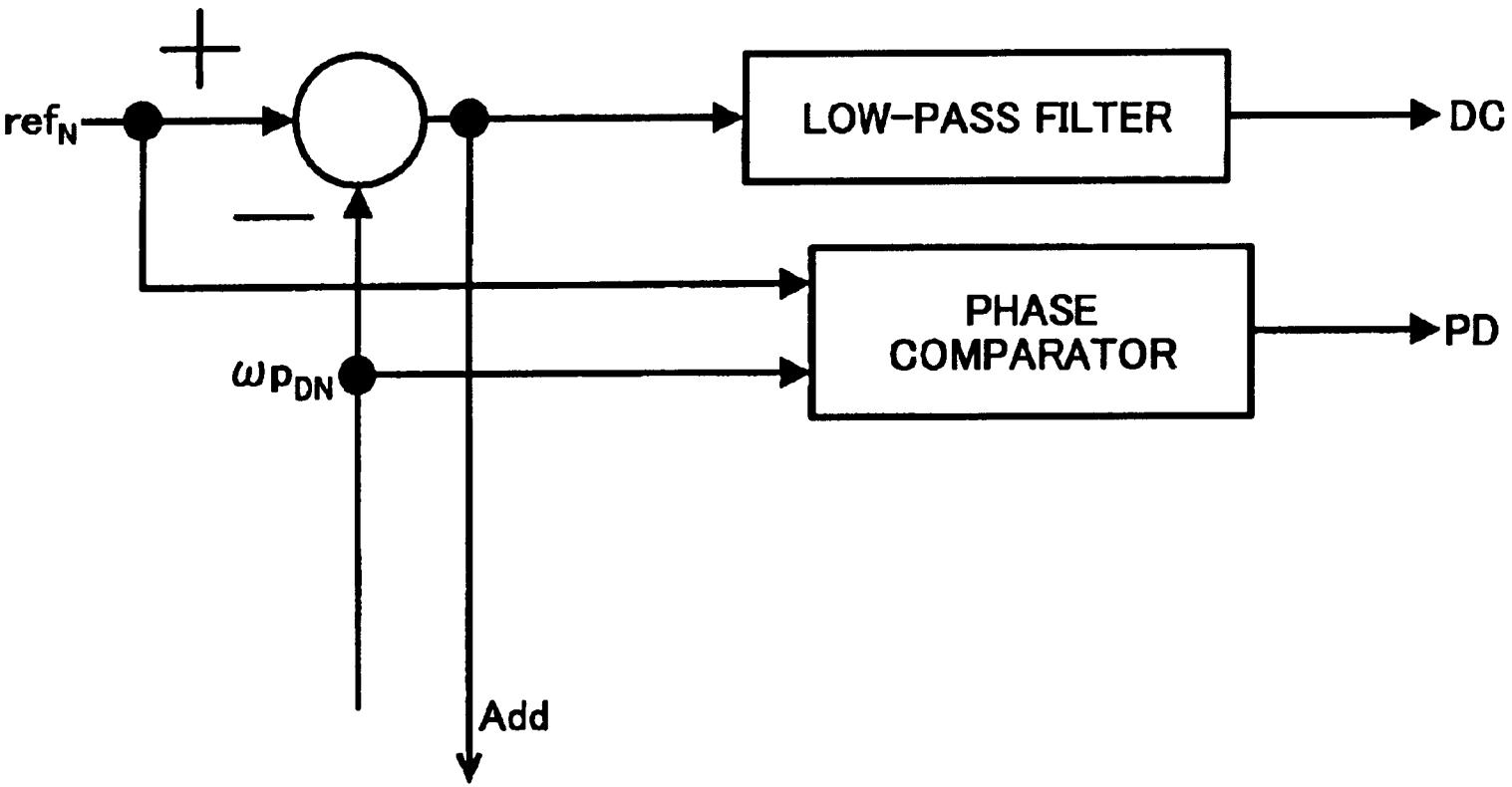
FIG. 7 is a schematic block diagram showing circuitry to be added to the control means of FIG. 6.

FIG. 7 shows circuitry which may be added to the circuitry of FIG. 6. As shown, the circuitry of FIG. 7 produces a phase difference PD between the sinusoidal reference input $ref_N$ having the thickness variation frequency components and the AC component or variation component $\omega P_{DN}$ produced by delaying the signal representative of the angular velocity of the driven roller 502 and multiplying it by the gain, as stated earlier. The phase of the reference signal $ref_N$ is shifted such that the phase difference PD becomes minimum. Also, the amplitude of the reference signal $ref_N$ is varied such that DC, produced by smoothing a difference Add between the reference signal $ref_N$ and the AC component $\omega p_{DN}$, becomes minimum. This successfully sets a reference signal with a minimum of belt speed variation ascribable to belt thickness variation. The amount by which the amplitude of the reference signal is corrected can be determined in accordance with the difference output Add.

Alternatively, there may be measured a phase difference and an amplitude difference between the reference signal $ref_N$ and the AC component $\omega p_{DN}$, so that the reference signal can be immediately corrected in accordance with the phase and amplitude differences measured. In such a case, the AC component $\omega p_{DN}$ is digitized while a controller, not shown, detects the resulting digital signal and then generate the reference input $ref_N$.

The gains Gdc and $G_N$ of the feedback signal are fixed constants determined by the configuration of the belt driveline, i.e., positions where the belt 500 is passed over a plurality of rollers. For example, assuming that the driven roller 502 has the same radius as the drive roller 501, i.e., $\alpha=\beta$, then the gain $G_N$ is produced by:

$$G_N=1 \tag{16}$$

Because the radius of the roller is generally far larger than the belt thickness $B_{to}$, the following relation holds:

$$B_{to}<<R_E,\ B_{to}<<R_D \tag{17}$$

The gain $G_N$ may therefore be approximately dealt with as:

$$G_N-(\beta/\kappa)(R_E/R_D)^2 \tag{18}$$

A particular thickness variation frequency component appears in each belt driveline, i.e., depending on positions where the belt is passed over rollers. How Control 1 deals with such particular frequency components will be described hereinafter.

If the belt driveline is laid out to satisfy the following condition (1) or (2), then a control system, which corrects a frequency component matching with the condition, can be simplified.

(1) Assume that the distance by which the belt moves from the driven roller to the drive roller is an even multiple (full wave) of one-half of the period of thickness variation. Then, there holds $\omega_N\tau=2\Pi N_\omega$ where $N_\omega$ is a natural number. It follows that the equations (9) and (10) are rewritten as:

$$\omega_E=\{V/(R_E+\kappa B_{to})\}-\{V\cdot\kappa/(R_E+\kappa B_{to})^2\}B_{tN}\cdot\sin(\omega_N t+\alpha_N). \tag{19}$$

$$\begin{aligned}\omega_D &= \{V/(R_D+\beta B_{to})\}-\{V\cdot\beta/(R_D+\beta B_{to})^2\}B_{tN}\cdot \\ &\quad \sin\{\omega_N(t-\tau)+\alpha_N\} \\ &= \{V/(R_D+\beta B_{to})\}-\{V\cdot\beta/(R_D+\beta B_{to})^2\}B_{tN}\cdot \\ &\quad \sin\{\omega_N t+\alpha_N\}\end{aligned} \tag{20}$$

Therefore, the AC component $\omega p_{DN}$, satisfying the above conditions, can be generated by multiplying the AC component of the thickness variation frequency component derived from the encoder output by the gain $G_N$. This can be done without resorting to the $T\tau$ delay circuit shown in FIG. 6.

(2) Assume that the distance by which the belt moves from the driven roller to the drive roller is an odd multiple (half wave) of one-half of the period of thickness variation. Then, assuming that $\omega_N\tau=\Pi(2N_\omega+1)$ where $N_\omega$ is a natural number, then the equations (9) and (10) are rewritten as:

$$\omega_E=\{V/(R_E+\kappa B_{to})\}-\{V\cdot\kappa/(R_E+\kappa B_{to})^2\}B_{tN}\cdot\sin(\omega_N t+\alpha_N). \tag{21}$$

$$\begin{aligned}\omega_D &= \{V/(R_D+\beta B_{to})\}-\{V\cdot\beta/(R_D+\beta B_{to})^2\}B_{tN}\cdot \\ &\quad \sin\{\omega_N(t-\tau)+\alpha_N\}\end{aligned} \tag{22}$$

-continued $$\begin{aligned}&= \{V/(R_D+\beta B_{to})\}+\{V\cdot\beta/(R_D+\beta B_{to})^2\}B_{tN}\cdot \\ &\quad \sin\{\omega_N t+\alpha_N\}\end{aligned}$$

Therefore, the AC component $\omega p_{DN}$, satisfying the above conditions, can be generated by inverting the AC component of the thickness variation frequency component derived from the encoder output and then multiplying it by the gain $G_N$. This can also be done without resorting to the $T\tau$ delay circuit shown in FIG. 6.

Assume the arrangement of the driven roller 502 and drive roller 501 shown in FIG. 1 as an exceptional configuration. Then, there can be executed control that controls the odd components of thickness variation, including a one-turn period component, without taking account of a delay time. Therefore, when the thickness variation components are taken into account, the delay circuit can be omitted. For example, if the AC component or thickness variation component contains only a one-turn period component, then the delay circuit is not necessary for the configuration of FIG. 1. It suffices to feed back the odd components after inversion and directly feed back the even components.

As stated above, Control 1 uses the angular velocity or the angular displacement of the driven roller remote from the drive roller. Therefore, even when the drive roller 501 and belt 500 slip on each other, thickness variation can be corrected without regard to the slip only if the driven roller 502 and belt 500 do not slip on each other.

[Control 2]

Control 2, which uses a learning method, causes the belt 500 to make one or more turns while sensing the amplitudes and phases of belt thickness, thereby correcting thickness variation. While the motor or drive source may be either one of a pulse motor and a servo motor, Control 2 is assumed to use a pulse motor by way of example. When use is made of a servo motor, a system for controlling the drive side to constant speed during learning is essential. In the event of drive after learning, it suffices to execute PLL control by using a clock generated in Control 2 as a reference. An implementation capable of correcting thickness variation without regard to the slip of the drive roller, which is added to Control 2, will be described later.

As for the correction of thickness variation, Control 2 uses a home sensor that outputs a single pulse for one turn of the belt 500. More specifically, a reference mark is provided on the belt 500 and sensed by a mark sensor affixed to a given stationary portion around the belt 500.

Assume that the thickness variation frequency component has an angular velocity frequency $\omega_{DN}$ at the drive roller side and has an angular velocity frequency $\omega_{EN}$ at the encoder side. Then, the feedback system executes control on the basis of:

$$\omega_{DN}=G_N\cdot\omega_{EN}\{t-(T-\tau)\} \tag{23}$$

where $\omega_{EN}$ is an encoder output appearing when the belt 500 moves at the constant speed V. The equation (19) derives the variation amplitude $\omega A_E$ of the encoder output $\omega_{EN}$ as:

$$A_E=\{V\cdot\kappa/(R_E+\kappa B_{to})^2\}B_{tN} \tag{24}$$

Also, the equation (20) derives the variation amplitude $A_D$ of $\omega_{DN}$ as:

$$A_D=\{V\cdot\beta/(R_D+\beta B_{to})^2\}B_{tN} \tag{25}$$

A learning system unique to Control 2 will be described hereinafter. Assume that the angular velocity of the drive roller is $\omega_{Do}$ when the pulse motor is controlled to a preselected angular velocity without feedback. Then, the speed of an intermediate image transfer belt, passed over the drive roller, varies by Vv in accordance with the variation of the belt thickness. The variation Vv is expressed as:

$$Vv=\omega_{Do}\cdot[R_D+\beta B_{to}+\beta B_{tN}\cdot\sin\{\omega_N(t-\tau)+\alpha_N\}] \tag{26}$$

$$\begin{aligned}\omega_E &= Vv/(R_E+\kappa B_t) \\ &= Vv/\{(R_E+\kappa B_{to}+\kappa B_{tN}\cdot\sin(\omega_N t+\alpha_N)\} \\ &= \omega_{D0}\cdot[R_D+\beta B_{to}+\beta B_{tN}\cdot\sin\{\omega_N(t-\tau)+\alpha_N\}]/ \\ &\quad \{(R_E+\kappa B_{to}+\kappa B_{tN}\cdot\sin(\omega_N t+\alpha_N)\}\end{aligned} \tag{27}$$

$$\begin{aligned}&\omega_E\approx\omega_{Do}\cdot\{(R_D+\beta B_{to})/(R_E+\kappa B_{to})\} \\ &[1+\{\beta B_{tN}/(R_D+\beta B_{to})\}\cdot\sin\{\omega_N(t-\tau)+\alpha_N\}] \\ &[1-\{\kappa B_{tN}/(R_E+\kappa\beta B_{to})\})\cdot\sin(\omega_N t+\alpha_N)] \\ &\approx\omega_{Do}\cdot\{(R_D+\beta B_{to})/(R_E+\kappa B_{to})\} \\ &[1+\{B_{tN}/(R_D+\beta B_{to})\}\cdot\sin\{(\omega_N(t-\tau)+\alpha_N\} \\ &-\{\kappa B_{tN}/(R^E+\kappa B_{to})\}\cdot\sin(\omega_N t+\alpha_N)]\end{aligned} \tag{28}$$

First, assume that the driven roller has the same radius as the drive roller, i.e., $\omega_N\tau=\tau$ for the sake of is simplicity of description. At this instant, there holds $\kappa=\beta$. In this case, $\omega_{En}$ of the above equations representative of $\omega_E$ is expressed as:

$$\omega_{En}=\omega_{Do}\cdot[1-2\{\beta/(R_E+\beta B_{to})\}B_{tN}\cdot\sin(\omega_N t+\alpha_N)]. \tag{29}$$

Also, $\omega_D$ is expressed as;

$$\omega_D=\{V/(R_D+\beta B_{to})\}+\{V\cdot\beta/(R_D+\beta B_{to})^2\}B_{tN}\cdot\sin\{\omega_N t+\alpha_N\}. \tag{30}$$

During measurement of belt thickness, the angular velocity $\omega D_o$ is set on the assumption that the target belt speed V is free from belt thickness variation, so that there holds $\omega_{Do}=V\cdot/(R_D+\omega B_{to})$. Therefore, $\omega_D$ can be expressed as:

$$\omega_D=\omega_{Do}+\omega_{Do}\{\beta/(R_D+\beta B_{to})\}B_{tN}\cdot\sin\{\omega_N t+\alpha_N\} \tag{31}$$

Therefore, from the equations (24) and (25), the amplitude Am of the frequency component ωN of $\omega_{En}$ when the target belt speed is V is derived as:

$$Am=2\omega_{Do}\{\beta/(R_E+\beta B_{to})\}B_{tN}=2A_E=2A_D \tag{32}$$

In the configuration of FIG. 4 in which the driven roller 502 has the same radius as the drive roller 501, i.e., $\omega_{N\tau}=\Pi$ holds, it suffices to halve the amplitude of the thickness variation frequency component of the encoder output, which appears when the drive roller 501 is driven at the constant angular velocity $\omega_{Do}$, and shift the phase by Π, thereby varying the angular velocity of the drive roller 501.

In a configuration in which the radius of the driven roller 502 differs from the radius of the drive roller 501, i.e., $\omega N\tau\neq\Pi$ holds, the thickness variation frequency component of the encoder output, appearing when the drive roller 501 is driven at the constant angular velocity $\omega_{Do}$, has an amplitude and a phase expressed as:

$$\begin{aligned}A &= \omega_{D0}\cdot\{(R_D+\beta B_{to})/(R_E+\kappa B_{to})\} \\ &\quad \{\beta B_{tN}/(R_D+\beta B_{to})\} \\ &= \omega_{D0}\beta B_{tN}/(R_E+\kappa B_{to})\end{aligned} \tag{33}$$

$$\begin{aligned}B &= \omega_{D0}\cdot\{(R_D+\beta B_{to})/(R_E+\kappa B_{to})\} \\ &\quad \kappa B_{tN}/(R_E+\kappa B_{to})\} \\ &= \omega_{D0}\kappa B_{tN}\cdot(R_D+\beta B_{to})/(R_E+\kappa B_{to})^2\end{aligned} \tag{34}$$

Figure 8:
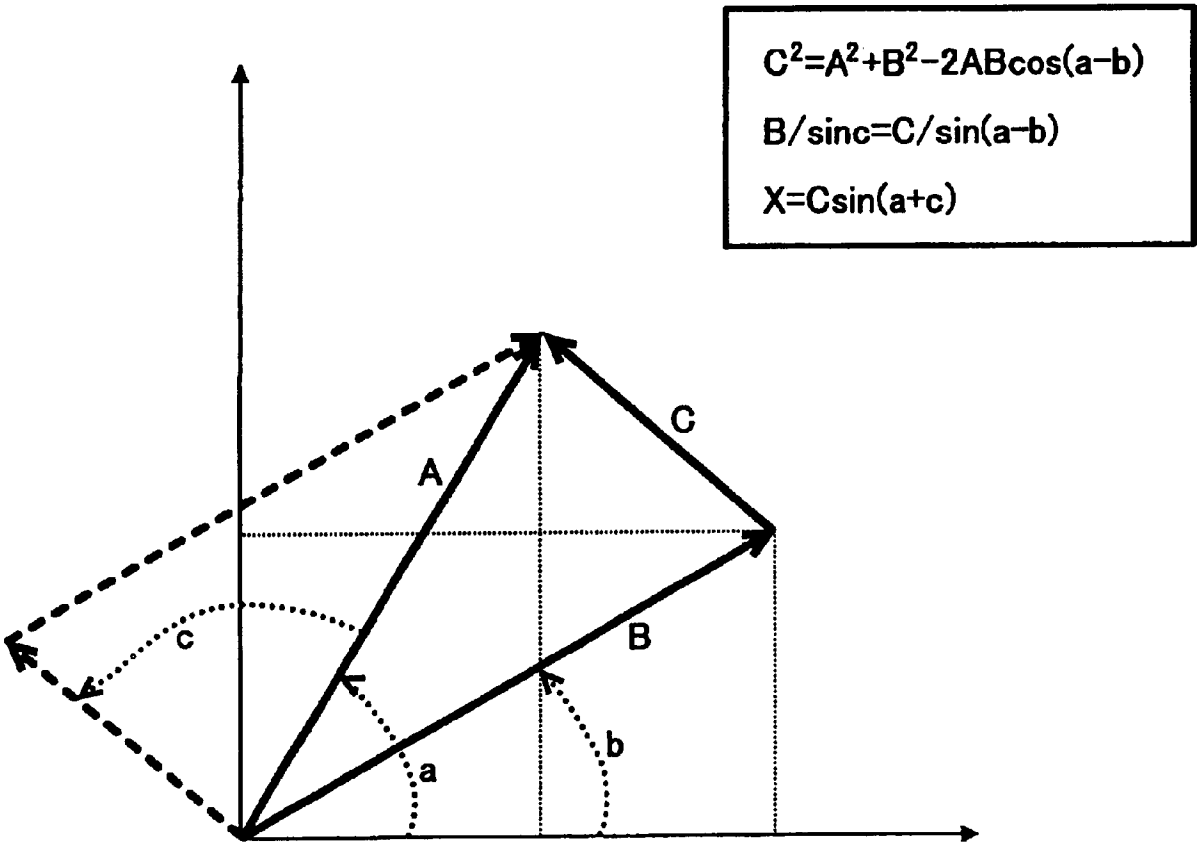
FIG. 8 is a vector diagram showing a relation between coefficients in the frequency components of belt thickness variation output from an encoder.

As shown in FIG. 8, C is derived from $a=\omega_N t-\omega_N\tau+\alpha_N$ and $b=\omega_N t+\alpha_{N\tau}$ as follows:

$$C^2=A^2+B^2-2AB\cdot\cos(a-b) \tag{35}$$

$$\begin{aligned}&C^2=\{\omega_{Do}\beta B_{tN}/(R_E+\kappa B_{to})\}^2+\{\omega_{Do}\kappa B \\ &tN\cdot(R_D+\beta B_{to})/(R_E+\kappa B_{to})^2\}^2-2\{\omega_{Do}\beta B_{tN}/( \\ &R_E+\kappa B_{to})\}\{\omega_{Do}\kappa B_{tN}\cdot(R_D+\beta B_{tN})/(R_E+\kappa B_{to})^2 \\ &\}\cdot\cos(-\omega_N\tau)\end{aligned} \tag{36}$$

$$\begin{aligned}&C=\{\omega_{Do}B_{tN}/(R_E+\kappa B_{to})\}[\beta^2+\kappa^2\cdot(R_D \\ &+\beta B_{to})^2/(R_E+\kappa B_{to})^2-2\{\beta/(R_E+\kappa B_{to})\} \\ &\{\kappa\cdot(R_D+\beta B_{to})\}\cdot\cos(-\omega_N\tau)]^{1/2}\end{aligned} \tag{37}$$

$$B/\sin c=C/\sin(a-b) \tag{38}$$

$$\begin{aligned}\sin c &= B\cdot\sin(a-b)/C \\ &= [\sin(-\omega_N\tau)\omega_{D0}\kappa B_{tN}\cdot(R_D+\beta B_{to})/ \\ &\quad (R_E+\kappa B_{to})^2]/[\{\omega_{D0}B_{tN}/(R_E+\kappa B_{to})\}\cdot \\ &\quad [\beta^2+\kappa^2\cdot(R_D+\beta B_{to})^2/(R_E+\kappa B_{to})^2- \\ &\quad 2\{\beta/(R_E+\kappa B_{to})\}\{\kappa\cdot(R_D+\beta B_{to})\}\cdot \\ &\quad \cos(-\omega_N\tau)]^{1/2}] \\ &= [\sin(-\omega_N\tau)]/[[(\beta/\kappa)^2(R_E+\kappa B_{to})^2/ \\ &\quad (R_D+\beta B_{to})^2+1-2\{(\beta/\kappa)(R_E+\kappa B_{to})^3\} \\ &\quad \{(R_D+\beta B_{to})^3\}\cdot\cos(-\omega_N\tau)]^{1/2}]\end{aligned} \tag{39}$$

$$c=\arcsin<<[\sin(-\omega_N\tau)]/[[(\beta/\kappa)^2(R_E+\kappa B_{to})^2/(R_D+\beta B_{to})^2+1-2\{(\beta/\kappa)(R_E+\kappa B_{to})^2\}\{(R_D+\beta B_{to})^2\}\cdot\cos(-\omega_N\tau)]^{1/2}]>> \tag{40}$$

Here, assuming that $g=(R_D+\beta B_{to})/(R_g+\kappa B_{to})$, then the above phase amount c is produced by:

$$c = \arcsin\langle\langle[\sin(-\omega_N\tau)]/[[\{\beta/(\kappa g)\}^2+1- 2(\beta/\kappa)g^3\cdot\cos(\omega_N\tau)]^{1/2}]\rangle\rangle \tag{41}$$

X included in the thickness variation frequency component represented by the equation (28) is expressed as:

$$\begin{aligned}X &= C\cdot\sin(a+c) \\ &= C\cdot\sin(\omega_N t-\omega_N\tau+c+\alpha_N) \\ &= C\cdot\sin[\omega_N\{t-(\tau-c/\omega_N)\}+\alpha_N)]\end{aligned} \tag{42}$$

The equation (42) gives, when the drive roller 501 is moving at the target angular velocity, the amplitude $A_D$ of the angular velocity as:

$$A_D=\{V\cdot\beta/(R_D+\beta B_{to})^2\}B_{tN} \tag{43}$$

Because $\omega_{Do}=V/(R_D+\beta B_{to})$ holds, the above amplitude AD is produced by:

$$A_D=\{\omega_{Do}\cdot\beta/(R_D+\beta B_{to})\}B_{tN} \tag{44}$$

Consequently, there holds:

$$A_D/C=\eta \tag{45}$$

$$\begin{aligned}\eta &= \{\omega_{D0}\cdot\beta/(R_D+\beta B_{to})\}B_{tN}/ \\ &[\{\omega_{D0}\cdot\beta_{tN}/(R_E+\kappa B_{to})\}\cdot[\beta^2+\kappa^2\cdot(R_D+\beta B_{to})^2/ \\ &(R_E+\kappa B_{to})^2-2\{\beta/(R_E+\kappa B_{to})\}\{\kappa\cdot(R_D+\beta B_{to})\}\cdot \\ &\cos(-\omega_N\tau)]^{1/2}] \\ &= \{(R_E+\kappa B_{to})/(R_D+\beta B_{to})\}/[[1+(\kappa/\beta)^2\cdot \\ &(R_D+\beta B_{to})^2/(R_E+\kappa B_{to})^2-2\{(\kappa/\beta)\cdot \\ &R_D+\beta B_{to})/(R_E+\kappa B_{to})\}\cdot\cos(-\omega_N\tau)]^{1/2}]\end{aligned} \tag{46}$$

By substituting $g=(R_D+\beta B_{to})/(R_g+\kappa B_{to})$, the above constant or amplitude coefficient $\eta$ is obtained as:

$$\eta=1/[g\cdot[1+(\kappa/\beta)^2\cdot g^2-2(\kappa/\beta)g\cdot\cos(\omega_N t)]^{1/2}] \tag{47}$$

Control 2 uses a home sensor responsive to the home position of the belt 500, as mentioned earlier. While the drive roller 501 is rotated at the constant angular velocity $\omega D_o$, data representative of angular velocity variation output from the encoder 601 for one-turn period are stored. The data are then subject to frequency analysis or FFT (Fast Fourier Transform) to thereby measure the amplitude or peak C of the frequency component to be corrected and a period of time Thm elapsed from the home position where the amplitude C is detected. By comparing the equations (10) and (42), it will be seen that it suffices to generate a pulse motor control clock that allows an amplitude $\eta C$, produced by multiplying the sensed amplitude or peak data C by $\eta$, to be obtained in a period of time of $(Thm+c/\omega_N)$ from the home position.

It is to be noted that calculating the angular velocity variation by FFT may be replaced with detecting an angular velocity variation frequency component with a band-pass filter, which passes the frequency component of belt speed variation to be reduced and ascribable to thickness variation.

Next, a procedure for detecting or separating a DC component corresponding to the thickness variation frequency will be described hereinafter. The angular velocity $\omega_D$ of the driven roller 502 can be determined in terms of the number of pulses sensed by the encoder over a preselected period of time or unit time Ts because the number of pulses is proportional to the angular velocity $\omega_D$.

Figure 9:
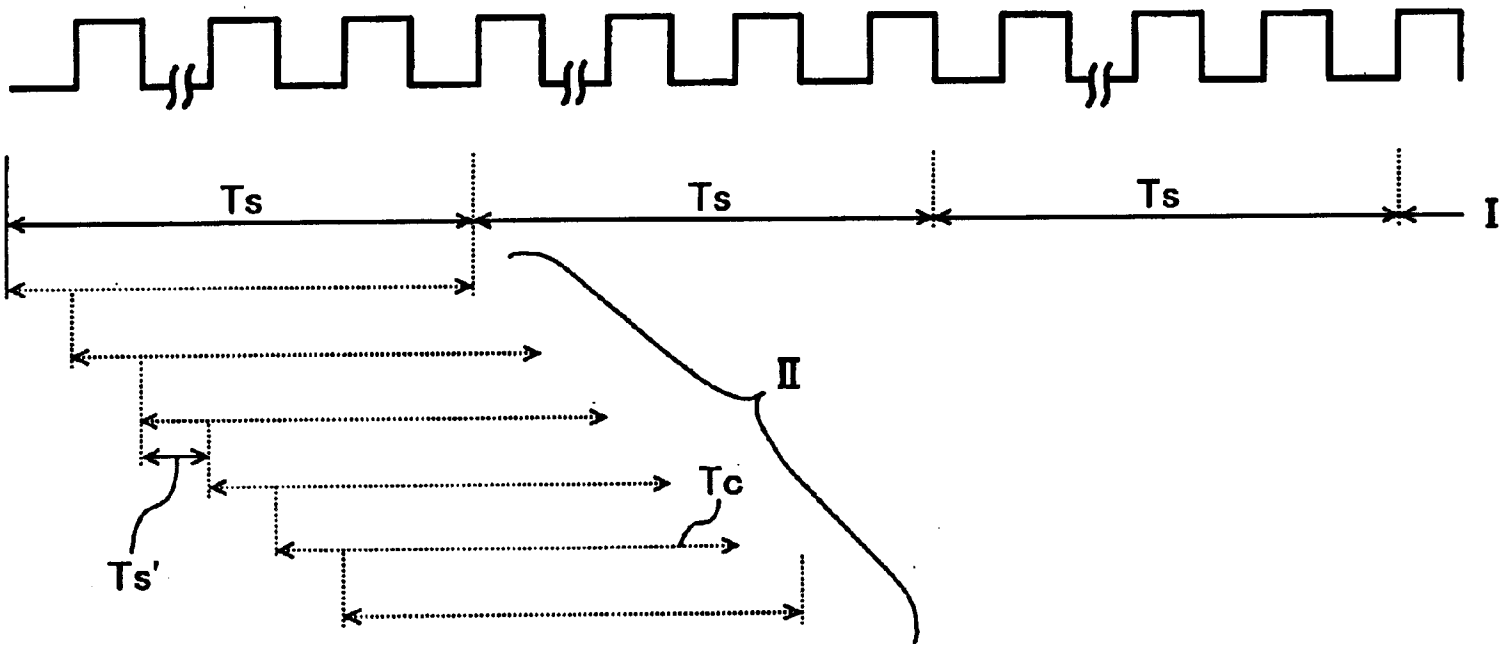
FIG. 9 shows two specific methods of Counting pulses output from the encoder.

The number of pulses for the unit time Ts may be counted by either one of the following two methods (i) and (ii):

(i) As shown in FIG. 9, I, pulses are counted over each preselected interval Ts; and (ii) As shown in FIG. 9, II, pulses are counted over a preselected interval Tc while the resulting count is used in every preselected period of time Ts'.

The method (ii) renders the resulting data smoother than the method (i). Ts or Ts' corresponds to data sampling timing.

It is possible to detect or separate, by using a band-pass filter, an AC component having the thickness variation frequency from a velocity signal thus detected.

The belt drive control device of the present invention will be described hereinafter. As shown in FIG. 5, the encoder 601, which outputs a pulse train in accordance with rotation, is mounted on the shaft of the driven roller 502 when the carrier frequency of a clock f input to the pulse motor, the angular velocity of the drive roller 501 varies. By modulating the frequency of the clock f with a sinusoidal wave whose amplitude and phase are adequately set at the rotation period, it is possible to reduce the influence of belt thickness variation on belt speed. To correct the N-th order belt speed variation, it suffices to modulate the clock f the N-th order sinusoidal wave having an adequate amplitude and an adequate phase.

In the case of feed forward control that directly sets a pulse train for the pulse motor driveline, it is possible to correct belt thickness variation. In the case of feedback control that generates a pulse train for comparing the encoder output and phase, it is possible to correct not only belt thickness variation but also slip between the drive roller 501 and the belt 500.

As for feed forward control, the pulse motor is rotated at a constant speed to cause the drive roller 501 to rotate at the constant angular velocity $\omega_{DO}$. The frequency component of the belt variation to be reduced, i.e., the angular velocity variation frequency component is detected by a band-pass filter and stored over th one-turn period. The following description will concentrate on the first-order variation frequency component. Subsequently, the amplitude C of the resulting variation data and a period of time Th elapsed from the home position where the zero-crossing point, i.e., positive-going point of the sinusoidal wave has been detected are measured. Thereafter, a pulse motor control clock in which the sinusoidal wave whose zero-crossing point appears in a period of time of $(Th+c/\omega_1)$ from the home position has an amplitude $-\eta C$ produced by multiplying the data C by $\eta$ is generated.

The angular velocity of the drive roller 501 is expressed as:

$$\omega=\omega o+\Delta\omega \tag{48}$$

$$\Delta\omega=-\eta C\cdot\sin[\omega_1\{t-(Th+c/\omega_1)\}] \tag{49}$$

where $\omega o=V/(R_D+\omega B_{to})$ holds, and t=0 occurs when the belt home position is sensed. The drive roller 501 must be driven such that a sinusoidal variation $\Delta\omega$ occurs.

A circuit for generating the clock f will be described hereinafter. Assume that the reference angular velocity of the drive roller 501 is determined by a clock reference frequency fo, and that an increment frequency for varying the angular velocity of the drive roller 501 from the reference angular velocity is $\Delta f$. Then, the angular velocity $\omega$ is expressed as:

$$\omega=2\pi(fo+\Delta f)/N \tag{50}$$

where N denotes the number of pulses of the clock f necessary for causing the drive roller 501 to make one rotation.

Further, when the drive roller 501 is so modulated as to sinusoidally vary the frequency for the purpose of reducing belt speed variation ascribable to belt thickness variation, the angular velocity $\omega$ of the drive roller 501 is produced by:

$$\omega=\omega o\{1+A\cdot\sin(\omega_1 t+\phi)\} \tag{51}$$

$$A=-\eta C/\omega o \tag{51a}$$

$$\phi=-\omega_1(Th+c/\omega_1)=-\omega_1 Th-c \tag{51b}$$

Consequently, the clock frequency f is derived from $f=(N/2\Pi)\omega$ as:

$$f=(N/2\pi)\omega o\{1+A\cdot\sin(\omega_1 t+\phi)\} \quad (52)$$

$$f=fo\{1+A\cdot\sin(\omega_1 t+\phi)\} \quad (53)$$

where fo is equal to $(N/2\Pi)\omega o$).

The pulse width Pw of the above clock is produced by:

$$Pw=1/f=(1/fo)[1/\{1+A\cdot\sin(\omega_1 t+\phi)\}] \quad (54)$$

$$Pw=(1/fo)\cdot[1-A\cdot\sin(\omega_1 t+\phi)] \quad (55)$$

where 1>> A.

L pulses of pulse width data are generated for pulse generation within the time range of $0\leqq t\leqq t$ where $T=2\Pi/\omega_1$.

A difference ΔPw produced by subtracting the pulse width Pwo=1/fo of the reference frequency from Pw is expressed as:

$$\Delta Pw = -(A/fo)\cdot\sin(\omega_1 t+\phi) \quad (56)$$

$$= -(A\cdot Pwo)\cdot\sin(\omega_1 t+\phi)$$

Further, assuming that the pulse width Pw is counted at a time interval of δP, then Pwo=Nc·δP (Nc being a natural number) holds. Therefore, the difference ΔPw is produced by:

$$\Delta Pw=\{-Nc\cdot A\cdot\sin(\omega_1 t+\phi)\}\delta P \quad (57)$$

A basic table relating to $\sin(\omega_1 t)$ shown above is prepared by using:

$$t_n=(T/L)\cdot n=\{2\pi/(L\omega_1)\}\cdot n \quad (58)$$

where n is 1, 2, . . . , L−1.

More specifically, a $\sin(\omega_1 t)$ basic table, corresponding to n included in $\sin(\omega_1 t_n)=\sin\{2\Pi(n/L)\}$, is generated.

The variation of the phase φ is implemented by varying a position where the basic table thus prepared starts being referenced. As for the amplitude A, multiplication is effected.

To generate the pulses Nc times as high as fo, use may alternatively be made of a conventional PLL circuit or an oscillator outputting a signal in which a clock frequency Nc·fo appears.

Figure 10:
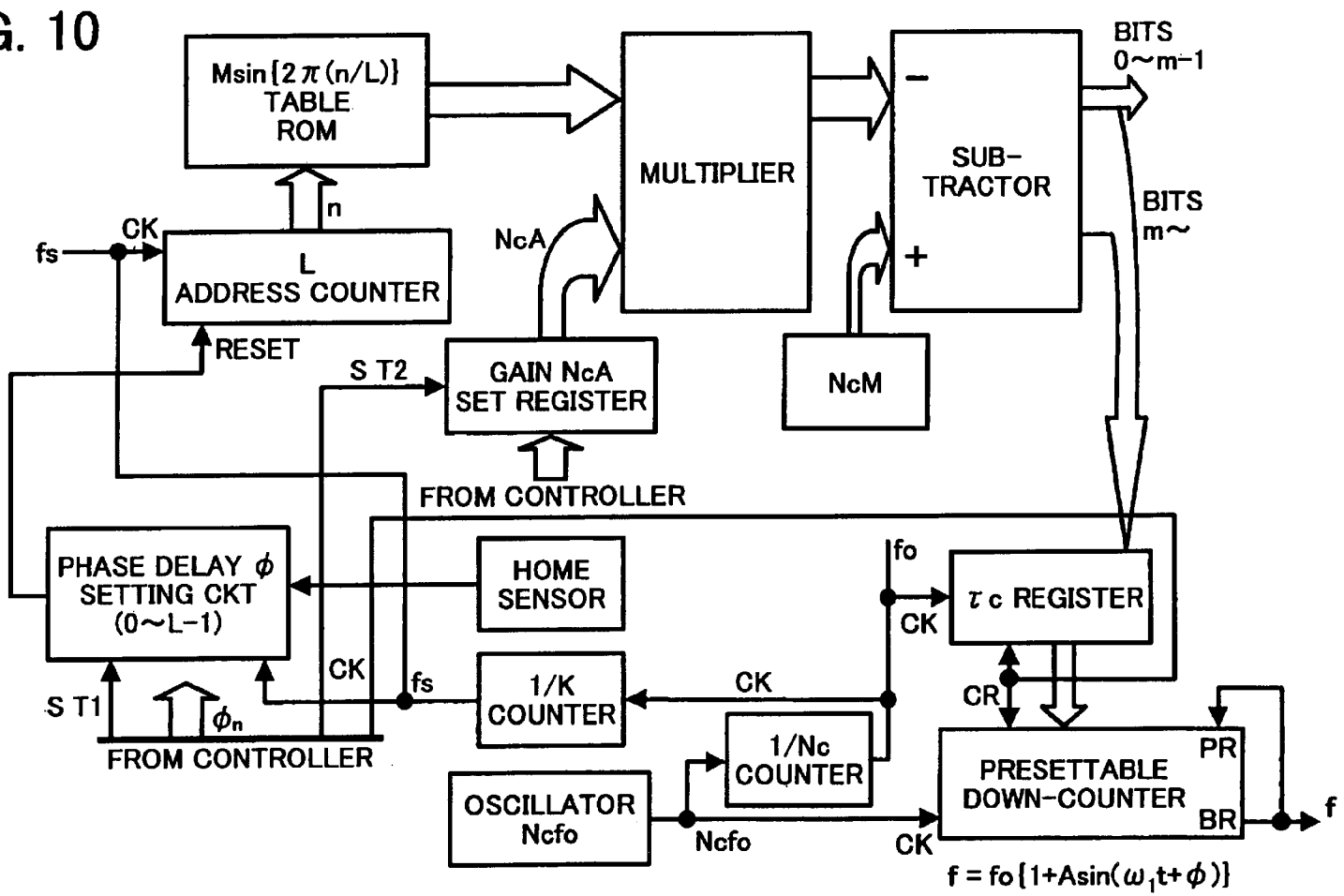
FIG. 10 is a schematic block diagram showing circuitry for generating a clock f.

FIG. 10 shows a specific circuit for outputting the clock f. Because the sinusoidal data are easy to deal with when represented by an integer, M is introduced as;

$$Pw = Pwo - Pwo\cdot A\cdot\sin(\omega_1 t+\phi) \quad (59)$$

$$= [\{Nc\cdot M - Nc\cdot A\cdot M\cdot\sin(\omega_1 t+\phi)\}/M]\cdot\delta P$$

M mentioned above is selected from $M=2^m$ (m being a natural number) that make $M\cdot\sin(\omega_1 t)$ an integer implementing required accuracy.

A controller, not shown, determines A based on the equation (51a) with a gain NcA set register, so that data NcA is sent from the register to an NcA multiplier. Nc is a natural number that allows NcA to sufficiently represent the accuracy of A. Also, the controller determines φ by use of the equation (51b) and sends data φn (n being an integer between 0 and L−1) derived from 2Π−φ to a phase delay φ setting circuit.

An $M\cdot\sin\{2\Pi(n/L)\}$ table ROM has a one code bit, m data bit configuration and outputs data $M\cdot\sin\{2\Pi(n/L)\}$ stored in an address n designated by an L address counter. The L address counter counts 0 to L−1 in accordance with a clock fs=fo/K where K is a natural number unconditionally determined when the size L of the sinusoidal wave table is determined. Thereholds T=LK/fo, i.e., foT/L.

After φn pulses of the clock fs, corresponding to the data φn designated by the controller, have been counted in response to a home pulse output from the home sensor, the phase φ set/delay circuit outputs a reset signal. Therefore, data can be output from the $M\cdot\sin\{2\Pi(n/L)\}$ table after φn pulses have been after the home pulse.

Subsequently, data for generating a pulse width τc is sent to a τc register via a multiplier and a subtractor. It is to be noted that omitting the data of lower bits 0 to m−1 included in the output of the subtractor is equivalent to executing division with M. Therefore, the data of lower bits 0 to m−1 are not sent to the TC register. A presettable down-counter outputs the clock f on the basis of the data of the τC register. More specifically, the down-counter is initially cleared by a reset signal CR fed from the controller, but immediately produces an output BR in response to a clock Ncfo and sets the data of the τc register therein. The down-counter sequentially down-counts the data in accordance with the clock Ncfo. As soon as the data reaches zero, the down-counter generates a pulse on its output BR while again setting the data of the τc register therein. At this time, th designated pulse width data is set. The BR output of the down-counter is the target clock f.

Figure 11:
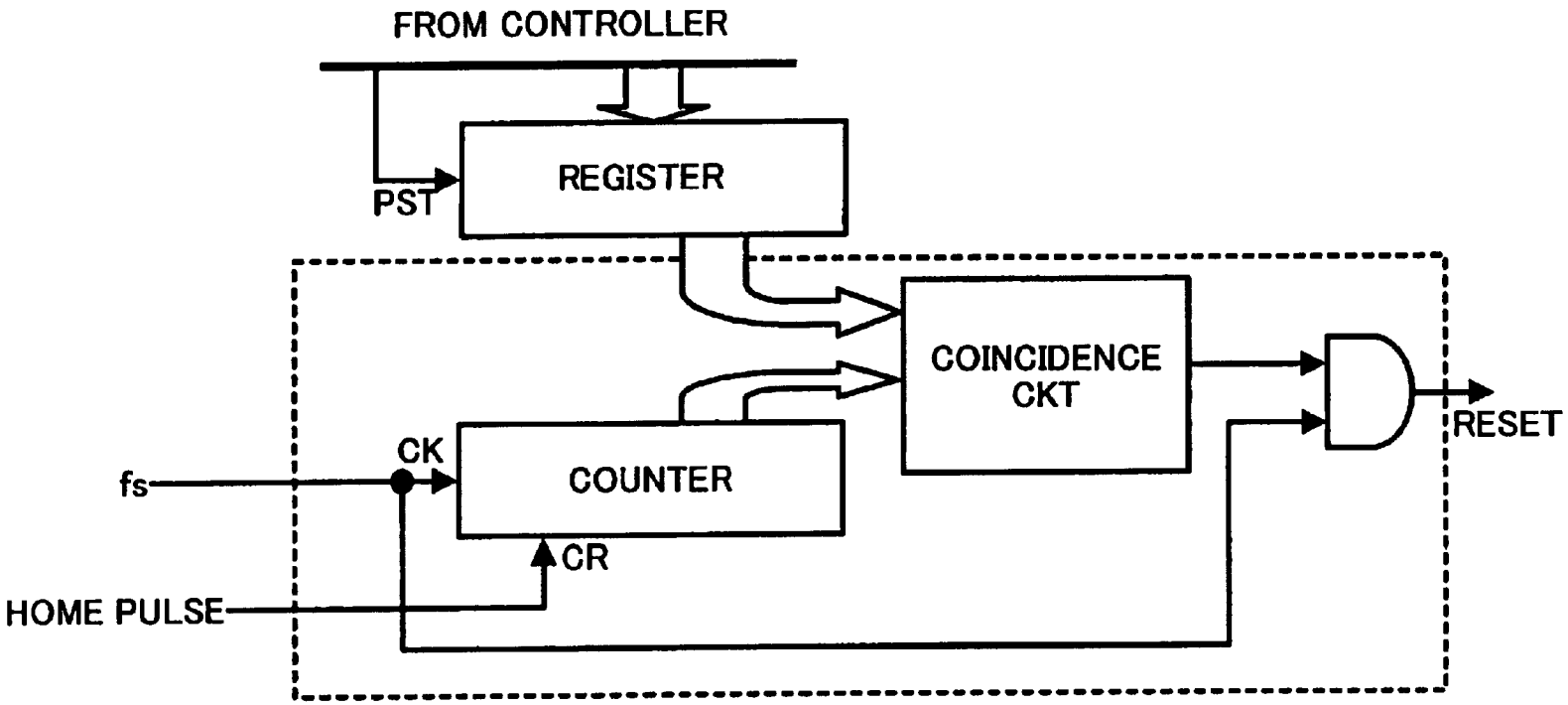
FIG. 11 is a schematic block diagram showing a schematic configuration of a phase delay setting circuit.

FIG. 11 shows a specific configuration of the phase delay φ setting circuit. The controller sets any one of 0 to L−1, which are the data φn corresponding to the phase (2Π−φ), in the phase delay φ setting circuit. Only if the optimum data (2Π−φ) or data A determined in the circuitry of FIG. 10 is stored in a nonvolatile memory, then control can be continuously executed by use of the above data so long as temperature variation or aging does not occur.

When it is desired to reduce slip between the belt 500 and the drive roller 501 and thickness variation at the same time, reference pulses to be compared with the encoder output are generated so as to determine η' included in an equation:

$$A_E/C=\eta' \quad (60)$$

A home sensor responsive to the home position of the belt 500 is provided while the drive roller 501 is rotated at a constant angular velocity $\omega_D$ so as to store data representative of belt variation for the one-turn period. This is done in the same manner as when $X=C\cdot\sin[\omega_{N1}\{t-(\tau-c/\omega_1)\}+\alpha_1]$ is taken into account. The amplitude C of the variation data and a period of time Thm' from the home position where the amplitude C has been detected are measured. By comparing the equations (19) and (42), it will be seen that it suffices to generate a reference clock for motor control that allows an amplitude η'C produced by multiplying the data C by η' to appear in a period of time of $(Thm'+c/\omega_1-\tau)$ from the home position.

Next, a specific configuration of the belt drive control device for executing feedback control with a DC motor will be described hereinafter. In this case, an encoder is mounted on the shaft of the drive roller 501 also. The output of the encoder is fed back to cause the drive roller 501 to rotate at the constant angular velocity $\omega_D$. At this instant, data representative of belt variation for the one-turn period are stored. Subsequently, the amplitude of the variation data and a period of time Th' from the home position where the zero phase of the zero-crossing point (positive-going portion) of the sinusoidal wave has been detected are measured. Then, there is generated a control clock for a DC pulse motor that allows the sinusoidal wave to have an amplitude $\eta'C$, produced by multiplying the data C by $\eta'$, in a period of time of $(Th'+c/\omega_1-\tau)$ from the home position.

The angular velocity of the driven roller 502 is expressed as:

$$\omega e=\omega eo+\Delta\omega e \tag{61}$$

$$\Delta\omega e=-\eta' C\cdot\sin\left[\omega_1[t-(Th'+c/\omega_1-\tau]\right] \tag{62}$$

where $\omega eo=V/(R_g+\kappa B_{to})$ holds, and t=0 occurs when the belt 500 is located at its home position. In this case, it is necessary to control the DC motor such that a sinusoidal variation $\Delta\omega e$ occurs in the driven roller 502.

A pulse generating circuit for generating a reference clock fref to be compared with a pulse frequency fe output from the encoder will be described hereinafter. Assume that a clock reference frequency for determining the reference angular velocity of the driven roller 502 is feo, and that an increment frequency for varying the driven roller 502 from the reference angular velocity is $\Delta fe$. Then, the angular velocity $\omega e$ of the driven roller 502 is expressed as:

$$\omega e=2\pi(feo+\Delta fe)/Ne \tag{63}$$

where Ne denotes the number of pulses of the clock fe necessary for causing the encoder to make one rotation.

Further, when the driven roller 502 is so modulated as to sinusoidally vary the frequency in order to reduce belt speed variation ascribable to belt thickness variation, the angular velocity $\omega e$ of the driven roller 502 is rewritten as:

$$\omega e=\omega eo\{1+A\cdot\sin(\omega_1 t+\phi)\} \tag{64}$$

$$A=-\eta' C/\omega eo \tag{64a}$$

$$\phi=-\omega_1(Th'+c/\omega_1-\tau) \tag{64b}$$

$$=-\omega_1 Th'-c/\omega_1\tau$$

The reference clock fref can be generated by circuitry similar to the circuitry shown in FIGS. 10 and 11.

Figure 12:
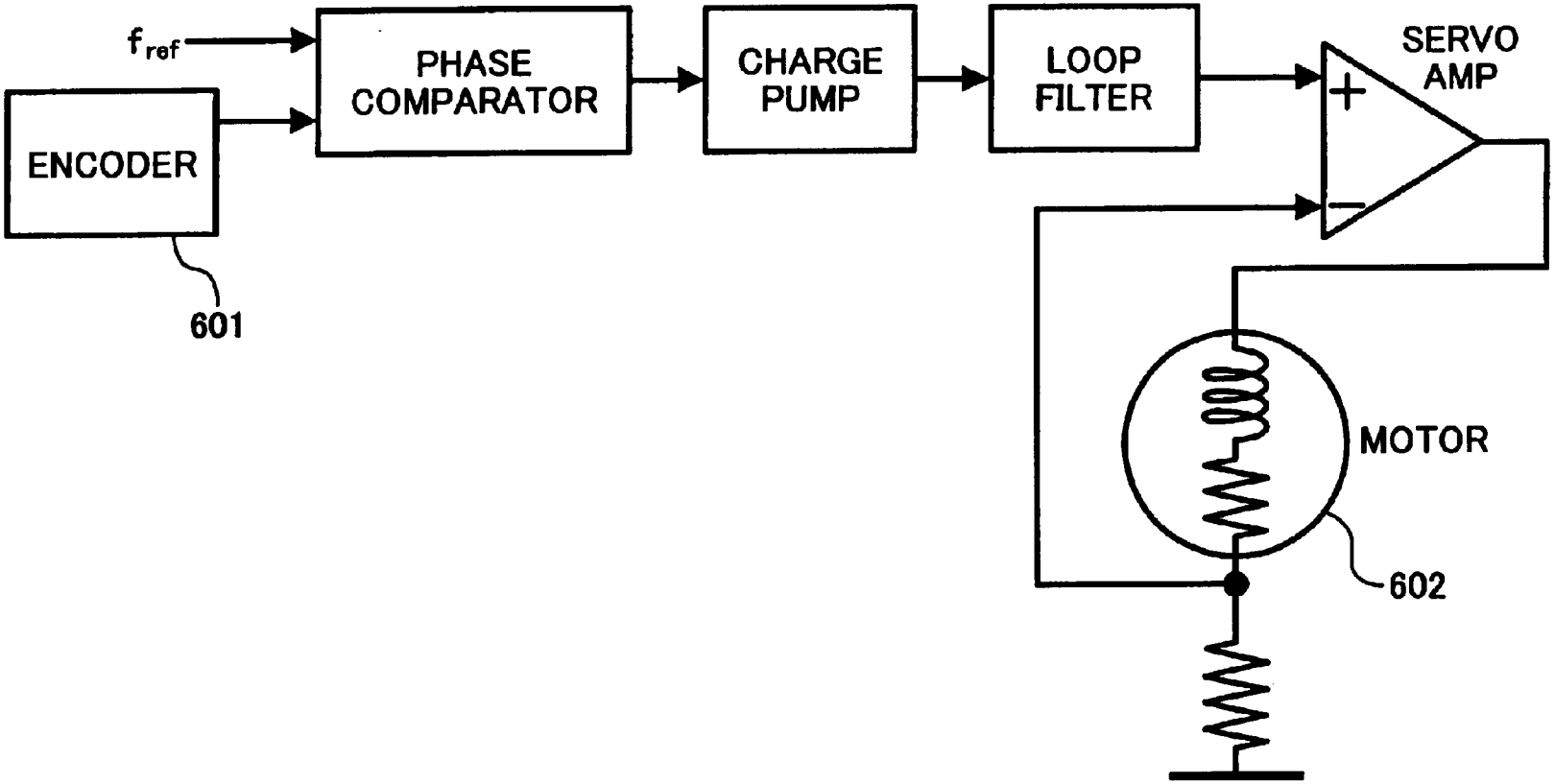
FIG. 12 is a schematic block diagram showing another specific control means applicable to a DC motor.

When the clock stated above is substituted for the reference clock fref shown in FIG. 12, there can be reduced belt speed variation ascribable to belt thickness variation and slip between the belt and the drive roller. FIG. 12 shows a conventional PLL control system including a phase comparator for comparing the reference input fref and encoder output fe, a charge pump, and a loop filter. In FIG. 12, a servo amplifier has a conventional current source type of configuration that senses a motor current.

Hereinafter will be described a specific configuration using a pulse motor and the reference clock fref stated above and capable of reducing belt speed variation ascribable to belt thickness variation and slip between the belt and the drive roller.

A clock fp for pulse motor control is generated in accordance with a difference $\theta e=\theta fref-\theta fe$ between the phase $\theta fref$ of the reference frequency fref and the phase $\theta fe$ of the pulse frequency of the encoder output.

Figure 13:
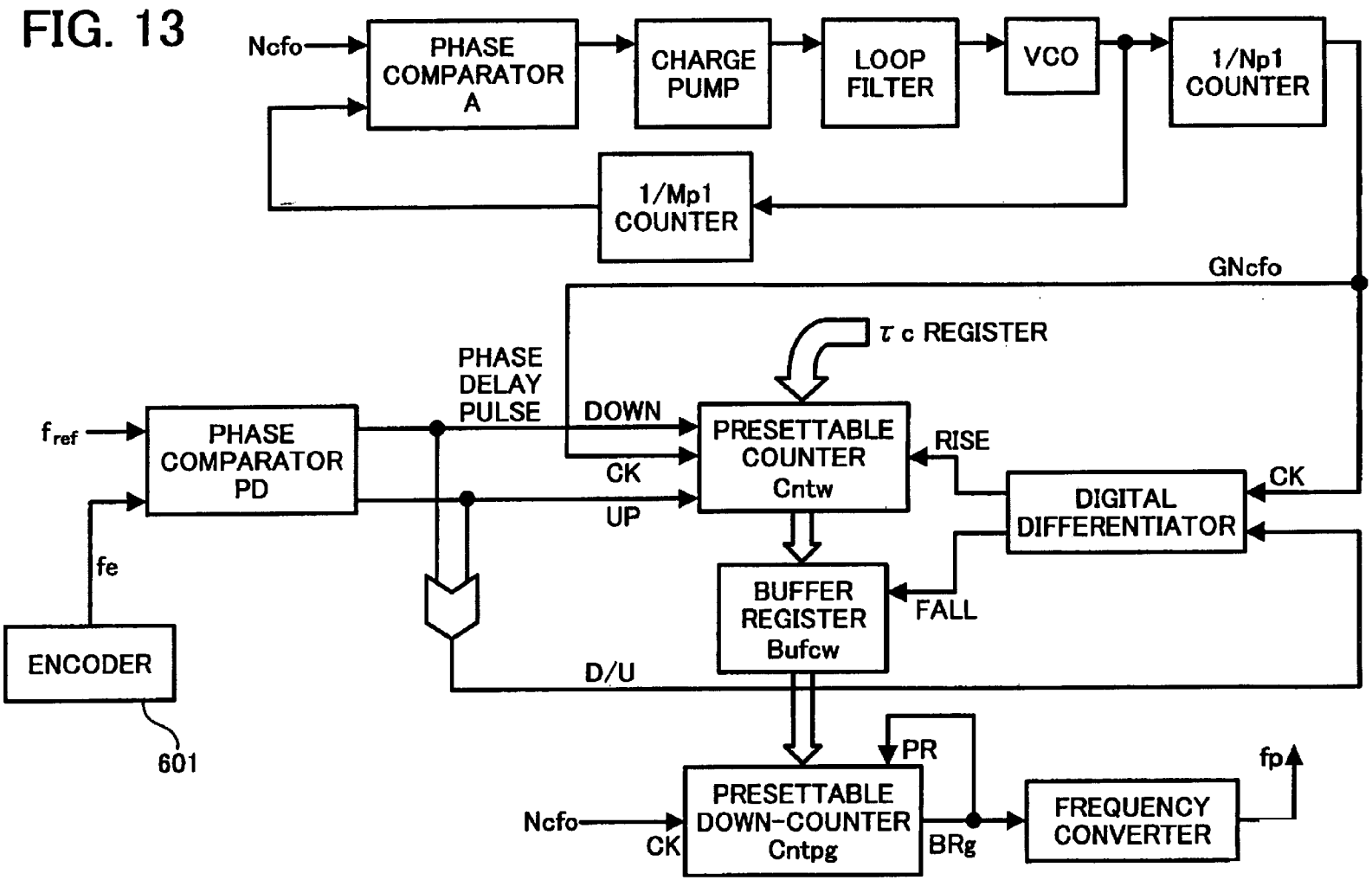
FIG. 13 is a schematic block diagram showing circuitry for producing a clock GNcfo.

FIG. 13 shows circuitry including a presettable counter Cntw in which data output from the $\tau c$ register, FIG. 10, is set; a word length is, e.g., two times as great as the maximum reference pulse width Ppw. The presettable counter Cntw counts, in accordance with a clock whose frequency is G times as high as the frequency of the clock Ncfo, FIG. 10, the encoder pulse width interval output from a phase comparator PD. This is equivalent to multiplying the gain of the control system by G=Mpl/Npl; G is a value determined by a target control error.

As shown in FIG. 13, a clock GNcfo is generated by a PLL circuit made up of a phase comparator A, a charge pump, a loop filter, a variable voltage controlled oscillator (VCO) and two 1/Npl counters. When the phase of the encoder output is delayed, the data set in the presettable counter Cntw is decremented (Down) to raise pulse frequency to be generated. When the above phase is advanced, the data in the presettable counter Cntw is increased (Up). More specifically, the data of the $\tau c$ register is set in the presettable counter Cntw at the leading edge of a pulse output from the phase comparator PD. When the presettable counter Cntw produces a carry or a borrow output, i.e., when the counter Cntw overflows, the counter Cntw is caused to stop counting, The output of the presettable counter Cntw is set in a buffer register Bufcw at the trailing edge of the pulse output from the phase comparator PD. The output of the buffer register Bufc is indicative of the pulse width of motor drive pulses.

The output of the buffer register Bufcw is set in a presettable down-counter Cntpg in accordance with the output BRg of the down-counter Cntpg. The down-counter Cntpg down-counts in accordance with the clock Cnfo because the data of the presettable counter Cntw varies around the reference pulse width Ppw, which is based on the reference frequency fref and set in the counter Cntw, in accordance with the output of the phase comparator PD. For example, if the down-counter Cntpg is caused to down-count in accordance with the clock GNcfo, then the reference pulse width Ppw is also modulated. The output BRg of the down-counter Cntpg is indicative of the drive frequency fp for the motor. A frequency converter is constructed in the same manner as the circuit included in FIG. 13 for converting the frequency Ncfo to the frequency GNcfo.

Figure 14:
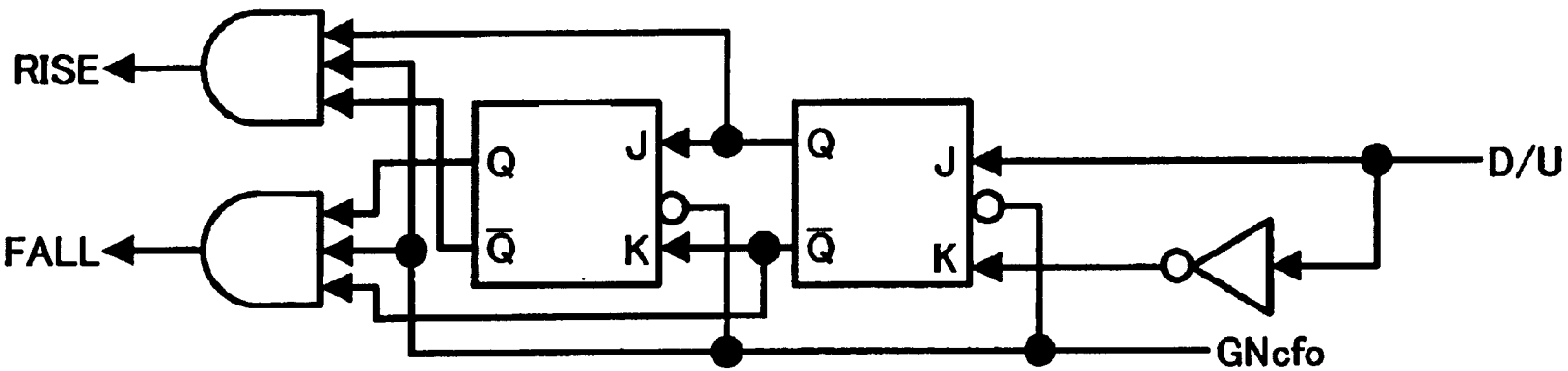
FIG. 14 is a schematic block diagram showing a specific configuration of a digital differentiator included in the circuitry of FIG. 13.

FIG. 14 shows a specific configuration of a digital differentiator included in the circuitry of FIG. 13. As shown, the digital differentiator is configured to produce an output Rise differentiated at the positive-going edge of an input signal pulse D/U and an output Fall differentiated at the negative-going edge of the same.

In the belt drive control device described above, the driven roller 502 provided with the encoder should preferably be located at a position where its shape is not susceptible to its own temperature variation or the temperature variation of rollers around it or th variation of ambient temperature. Stated another way, the encoder should preferably be located at a position where the variation of belt thickness ascribable to belt expansion or contraction is negligible.

More specifically, when roller temperature rises, it heats the belt 500 and thereby causes it to stretch with the result that the thickness of the belt 500 decreases. If the belt 500 wraps around the drive roller 501 before it is cooled off, then belt speed is lowered for a give rotation speed of the drive roller. At this instant, the influence of stretch of the belt 500 is absorbed by a tension roller. Further, the above roller temperature is transferred to the side upstream of the roller. Therefore, if the encoder is located at such a position, then the resulting information is erroneous due to the influence of temperature.

The variation of belt thickness ascribable to temperature stated above is longer in period than in the event of initial machining and may therefore be regarded as DC variation in the aspect of control. Assume that the encoder is located at a position where temperature varies little, and that control is executed in accordance with the output of the encoder. Then, in Control 1 or 2 and any one of the specific configurations of the drive control device stated earlier, information output from the encoder is directly fed back as a DC component. Because the DC component is controlled at a position not susceptible to thickness variation ascribable to temperature, belt speed variation ascribable to the variation of roller temperature does not occur.

The eccentricity of the drive roller and the eccentricity and transmission error of the drive transmission mechanism also result in periodic variations. In Control 1 or 2 and any one of the specific configurations of the belt drive control device stated earlier, the above variations can be reduced if they are detected by the encoder and processed in the same manner as thickness variation. In this case, AC components different in frequency from the thickness variation are separated from the data representative of angular displacement or angular velocity sensed by the encoder.

Part of the signal or data processing executed by the control means may be assigned to a microcomputer included in or separated from the controller and executing a preselected program stored in a ROM or a RAM (Random Access Memory), which is included in the microcomputer. Also, the program may be stored in a ROM or similar semiconductor memory, a CD-ROM, CD-R or similar optical disk, an PD, HD or similar magnetic disk, a magnet tape or similar recording medium and interchanged or interchanged via a computer network.

Figure 15:
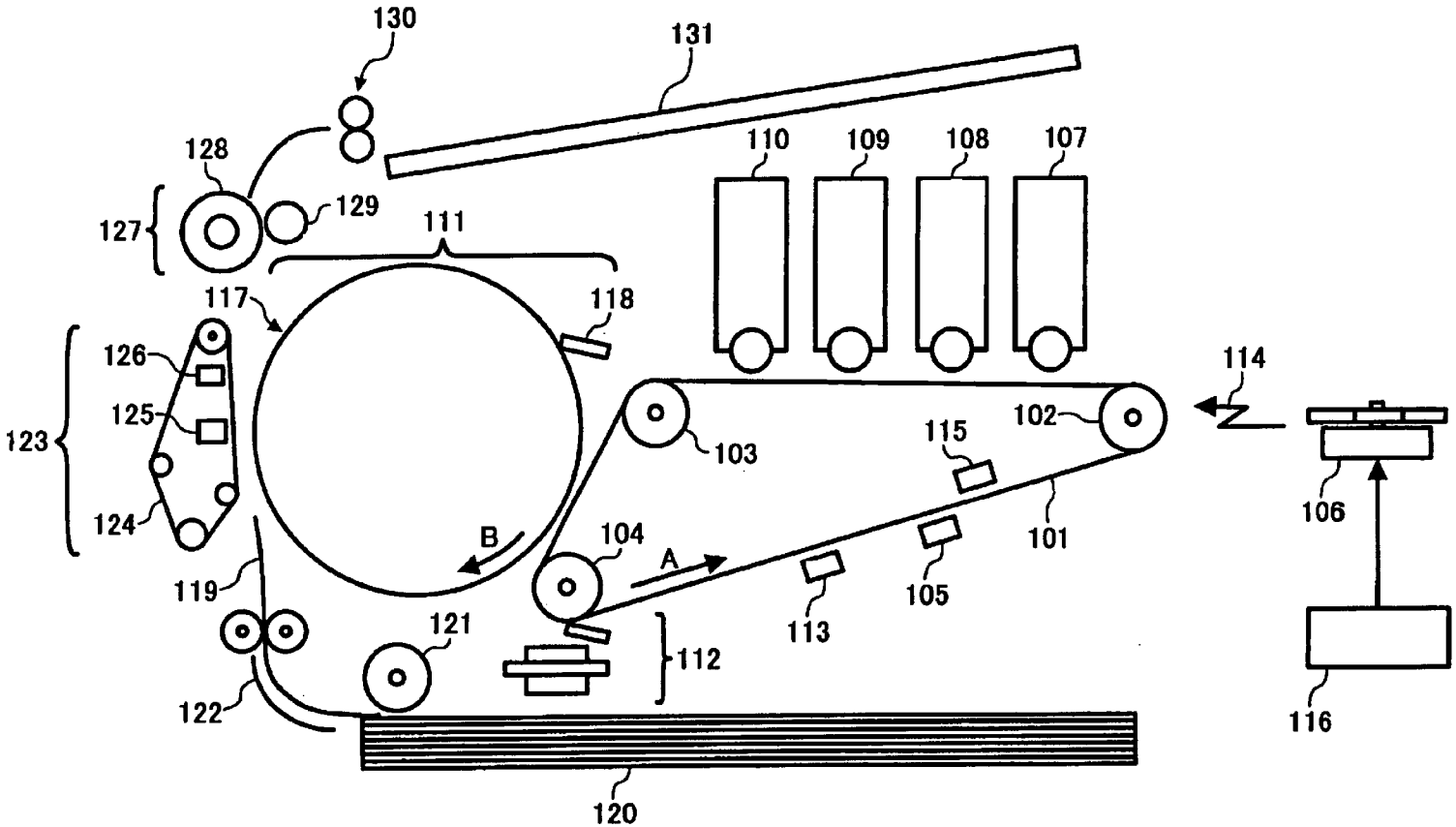
FIG. 15 shows an image forming apparatus embodying the present invention.

Referring to FIG. 15, an image forming apparatus to which the belt drive control device described above is applicable is shown and implemented as a color copier by way of example. As shown, a photoconductive element or image carrier 101 is implemented as an endless belt made up of an NL base and an OPC or similar photoconductive layer formed on the base as a thin film. The photoconductive element (belt hereinafter) 101 is passed over three rollers or rotary support bodies 102 through 104 and caused to turn in a direction indicated by an arrow A by a motor not shown.

A charger 105, a laser scanning unit 106, developing units 107 through 110, an intermediate image transferring unit 111, cleaning means 112 and a quenching lamp or discharger 113 are sequentially arranged around the belt 101 in this order in the direction A. The developing units 107 through 110 are a black, a yellow, a magenta and a cyan developing unit, respectively. The charger 105 is applied with a high-tension voltage of about −4 kV to 5 kV from a power supply, not shown, and uniformly charges the surface of the belt 101.

A laser driver, not shown, causes the laser scanning unit 106 to drive a laser, not shown, in accordance with signals produced by executing light intensity modulation or pulse width modulation with color-by-color image signals. The resulting laser beam 114 scans the charged surface of the belt 101 to thereby sequentially form latent images corresponding to the color-by-color image signals on the belt 101. When a seam sensor 115 senses the seam of the belt 101, a timing controller 116 controls the emission timing of the laser scanning unit 106 in such a manner as to avoid the seam and provide the latent images of different colors with the same angular displacement.

The developing units 107 through 110, each storing toner of a particular color, are selectively brought into contact with the belt 101 at particular timing matching with the latent images. As a result, toner images of different colors are superposed on each other, completing a four- or full-color toner image.

The intermediate image transferring unit 111 is made up of a drum-like intermediate image transfer body (drum hereinafter) 117 and cleaning means 118. The drum 117 is formed by wrapping a belt-like sheet formed of, e.g., conductive resin around a pipe formed of aluminum or similar metal. The cleaning means 118 is spaced from the drum 117 when the developing units 107 through 110 are forming the full-color image on the belt 101. When the cleaning means 118 is brought into contact with the drum 117, it removes toner left on the drum 117 without being transferred from the drum 117 to a sheet or recording medium 119. A sheet cassette 120 is loaded with a stack of sheets 119 and allows the sheets 119 to be sequentially fed to a conveyance path 112 one by one.

The image transferring unit or image transferring means 123 transfers the full-color image from the drum 117 to the sheet 119. The image transferring unit 123 includes a belt 124 formed of, e.g., conductive rubber. An image transferring device 125 applies a bias to the sheet 119 for transferring the full-color image from the drum 117 to the sheet 119. A peeler 126 applies a bias to the drum 117 so as to prevent the sheet 119, carrying the full-color image thereon, from electrostatically adhering to the drum 117.

A fixing unit 127 includes a heat roller 128, which accommodates a heat source therein, and a press roller 129 pressed against the heat roller 128. The heat roller 128 and press roller 129 fix the full-color image on the sheet 119 with heat and pressure while conveying the sheet 119.

The operation of the color copier will be described more specifically hereinafter on the assumption that a black, a cyan, a magenta and a yellow latent image are sequentially developed in this order.

The belt 101 and drum 117 are respectively moved in directions A and B by respective drive sources not shown. In this condition, the charger 105, applied with the high-tension voltage of −4 kV to 5 kV, uniformly charges the surface of the belt 101 to about −700 V. On the elapse of a preselected period of time since the seam sensor 115 has sensed the seam of the belt 101, the laser scanning unit 106 scans the charged surface of the belt 101 with the laser beam 114 in accordance with black image data in order to avoid the seam of the belt 101. As a result, the charge disappears in part of the belt 101 scanned by the laser beam 114, so that a latent image is formed.

The black developing unit 7 is brought into contact with the belt 101 at preselected timing and causes negatively charged black toner to deposit only on the latent image formed on the belt 101, producing a black toner image by so-called negative-to-positive development. The black toner image is then transferred from the belt 101 to the drum 117. The cleaning means 112 removes the black toner left on the belt 101 after the image transfer. Further, the quenching lamp 113 discharges the belt 101.

Subsequently, the charger 105 uniformly charges the surface of the drum 101 to about −700 V. Again, on the elapse of the preselected period of time since the seam sensor 115 has sensed the seam of the belt 101, the laser scanning unit 106 scans the charged surface of the belt 101 with the laser beam 114 in accordance with cyan image data, thereby forming a latent image. The cyan developing unit 108 is brought into contact with the belt 101 at preselected timing to develop the above latent image with cyan toner, which is also charged to negative polarity, thereby producing a corresponding cyan toner image. The cyan toner image is then transferred from the belt 101 to the drum 117 over the black toner image. After the image transfer, the cleaning means 112 again cleans the surface of the belt 101, and then the quenching lamp 113 discharges the belt 101.

Subsequently, the charger 105 uniformly charges the surface of the drum 101 to about −700 V. Again, on the elapse of the preselected period of time since the seam sensor 115 has sensed the seam of the belt 101, the laser scanning unit 106 scans the charged surface of the belt 101 with the laser beam 114 in accordance with magenta image data, thereby forming a latent image. The magenta developing unit 109 is brought into contact with the belt 101 at preselected timing to develop the above latent image with magenta toner, which is also charged to negative polarity, thereby producing a corresponding magenta toner image. The magenta toner image is then transferred from the belt 101 to the drum 117 over the black and cyan toner image. After the image transfer, the cleaning means 112 again cleans the surface of the belt 101, and then the quenching lamp 113 discharges the belt 101.

Further, the charger 105 uniformly charges the surface of the drum 101 to about −700 V. Again, on the elapse of the preselected period of time since the seam sensor 115 has sensed the seam of the belt 101, the laser scanning unit 106 scans the charged surface of the belt 101 with the laser beam 114 in accordance with yellow image data, thereby forming a latent image. The magenta developing unit 110 is brought into contact with the belt 101 at preselected timing to develop the above latent image with yellow toner, which is also charged to negative polarity, thereby producing a corresponding yellow toner image. The yellow toner image is then transferred from the belt 101 to the drum 117 over the black, cyan and magenta toner image, completing a full-color image. After the image transfer, the cleaning means 112 again cleans the surface of the belt 101, and then the quenching lamp 113 discharges the belt 101.

Subsequently, the image transferring unit 123 is brought into contact with the drum 117. In this condition, the image transferring device 125, applied with a high-tension voltage of about +1 kV, transfers the full-color image from the drum 117 to the sheet 119 fed from the sheet cassette 120.

A power supply applies a voltage to the peeler 126 such that the peeler 126 electrostatically attracts the sheet 119 carrying the full-color image thereon. The peeler 126 therefore peels off the sheet 119 from the drum 117. The sheet 119 is then conveyed to the fixing unit 129 and has its full-color image fixed by the heat roller 129 and press roller 129. Subsequently, the sheet or full-color copy is driven out to a copy tray 131 by an outlet roller pair 130.

After the transfer of the full-color image from the drum 117 to the sheet 119, the cleaning means 118 is brought into contact with the drum 117 in order to remove the toner left on the drum 117.

In the color copier described above, the accuracy of rotation of the belt 101 and drum 117 has critical influence on the quality of an image. In light of this, the belt drive control device stated earlier controls the drive of the belt 101 in such a manner as to sequentially form toner images of different colors free from irregular density and color shift, thereby insuring high image quality.

If desired, there may be constructed a photoconductive belt device including the belt 101, the rollers 101 through 104, an encoder associated with any one of the rollers 101 through 104 playing the role of a rotary driven body, a motor assigned to another roller playing the role of a rotary drive body, and the belt driving device stated earlier. Further, the photoconductive belt device may be constructed into a single process cartridge removably mounted to the apparatus of an image forming apparatus and therefore easy to maintain or replace.

Figure 16:
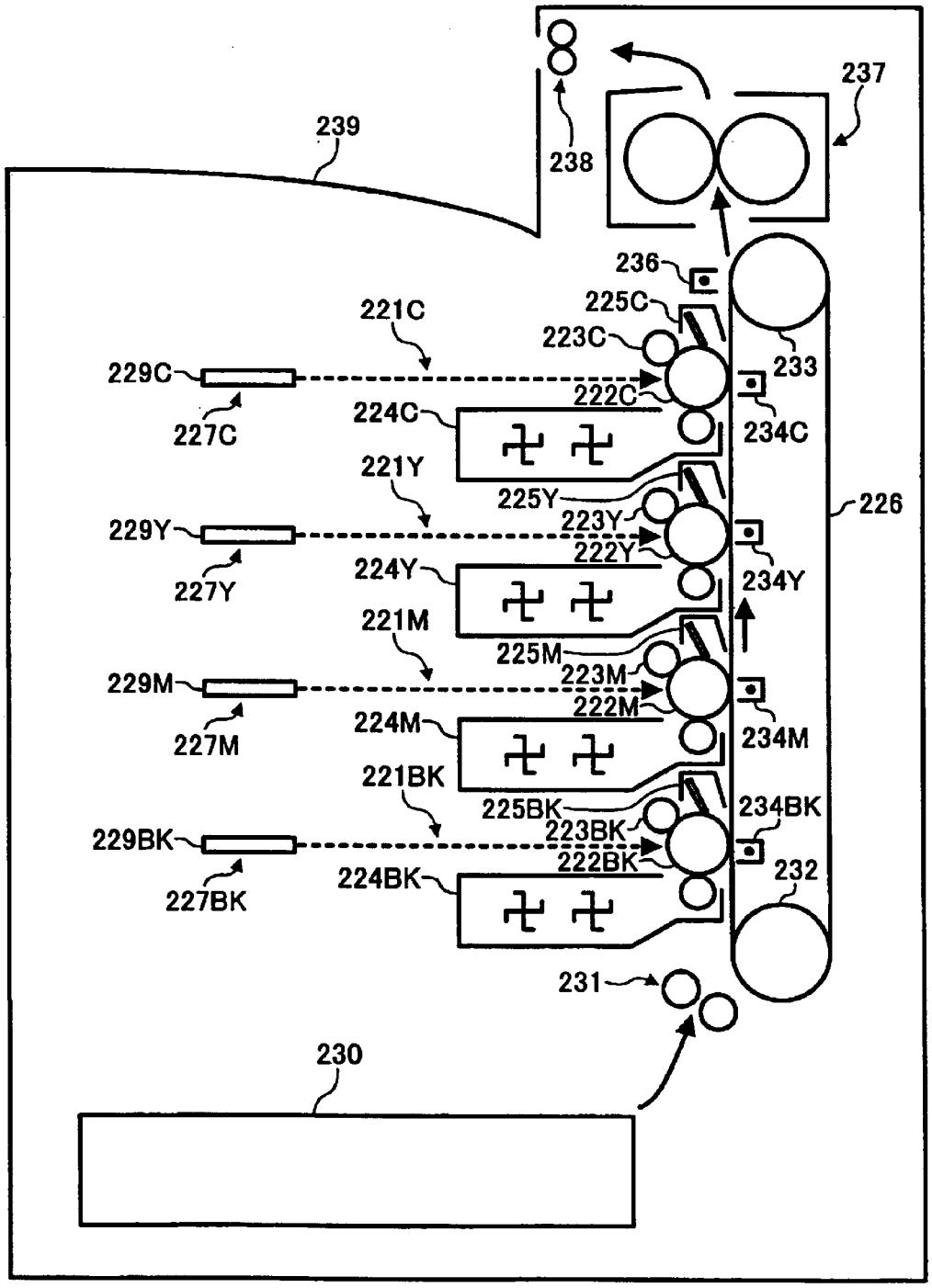
FIG. 16 shows an alternative embodiment of the present invention.

FIG. 16 shows a tandem color copier which is another image forming apparatus to which the belt drive control device is applicable. As shown, the tandem color copier includes image forming units 221Bk (black), 221M (magenta) 221Y (yellow) and 221C (cyan) positioned one above the other. The image forming units 221Bk, 221M, 221Y and 221C respectively include photoconductive drums or image carriers 222Bk, 222M, 222Y and 222C, contact type or similar chargers 223Bk, 223M, 223Y and 223C, developing devices 224Bk, 224M, 224Y and 224C, and cleaning devices 225Bk, 225M, 225Y and 225C.

The drums 222Bk through 222C face an endless belt 226 and are driven at the same peripheral speed as the belt 226. The drums 222Bk, 222M, 222Y and 222C are respectively uniformly charged by the chargers 223Bk, 223M, 223Y and 223C and then scanned by laser scanning units or exposing means 227Bk, 227M, 227Y and 227C. As a result, a Bk, an M, a Y and a C latent image are formed on the drums 222Bk, 222M, 222Y and 222C, respectively.

In each of the laser scanning units 227Bk, 227M, 227Y and 227C, a laser driver drives a semiconductor laser in accordance with Bk, M, Y or C image data to thereby cause the laser to emit a laser beam. The laser beam is then steered by associated one of polygonal mirrors 229Bk, 229M, 229Y and 229C toward the drum 222Bk, 222M, 222Y or 222C via an fθ lens and a mirror not shown, forming a latent image on the drum.

The latent images drums 222Bk through 222C are respectively developed by the developing devices 224Bk through 224C to become a Bk, an M, a Y and a C toner image. In this sense, the chargers 223Bk through 223C, laser scanning units 2276B through 227C and developing devices 224Bk through 224C constitute image forming means for forming the Bk through C toner images.

A plain paper sheet, OHP (OverHead Projector) sheet or similar sheet is fed from a cassette or sheet feeder 230 to a registration roller pair 231 along a conveyance path. The registration roller pair 231 once stops the sheet and then starts conveying it toward a nip between the belt 226 and the drum 222Bk, which is included in the image forming unit 221Bk of the first color), such that the leading edge of the sheet meets the leading edge of the Bk toner image formed on the drum 2226Bk.

The belt 226 is passed over a drive roller 232 and a driven roller 233. The drive roller 232 is rotated by a driveline, not shown, at the same peripheral speed as the drums 222Bk through 222C. While the belt 226 conveys the sheet fed via the registration roller pair 231, th Bk, M, Y and C toner images are sequentially transferred from the drums 222Bk through 222C to the sheet one above the other by corona chargers or image transferring means 234Bk through 234C, respectively. As a result, a full-color image is completed on the sheet. The belt 226 conveys the sheet while surely retaining it thereon by electrostatic attraction.

Subsequently, a separation charger or separating means 236 separates the sheet from the belt 226, and then a fixing unit 237 fixes the full-color image on the sheet. An outlet roller pair 238 conveys the sheet, carrying the fixed image thereon, to a stacking portion 239 positioned on the top of the copier. The cleaning devices 225Bk through 2250 respectively clean the surfaces of the drums 222Bk through 222C after the image transfer.

In the color copier described above, the accuracy of rotation of the belt 226 has critical influence on the quality of an image. In light of this, the belt drive control device stated earlier controls the drive of the belt 226. This allows the belt 226 to be driven at constant peripheral speed for thereby allowing the toner images of different colors to be transferred from the drums 222Bk through 222C to the sheet in accurate register with each other.

If desired, there may be constructed a belt conveyor device including the belt 226, the drive roller 232, the driven roller 233, an encoder associated with the driven roller 233, a motor assigned to the drive roller 232, and the belt driving device stated earlier. Further, the belt conveyor device may be constructed into a single process cartridge removably mounted to the apparatus of an image forming apparatus and therefore easy to maintain or replace.

Figure 17:
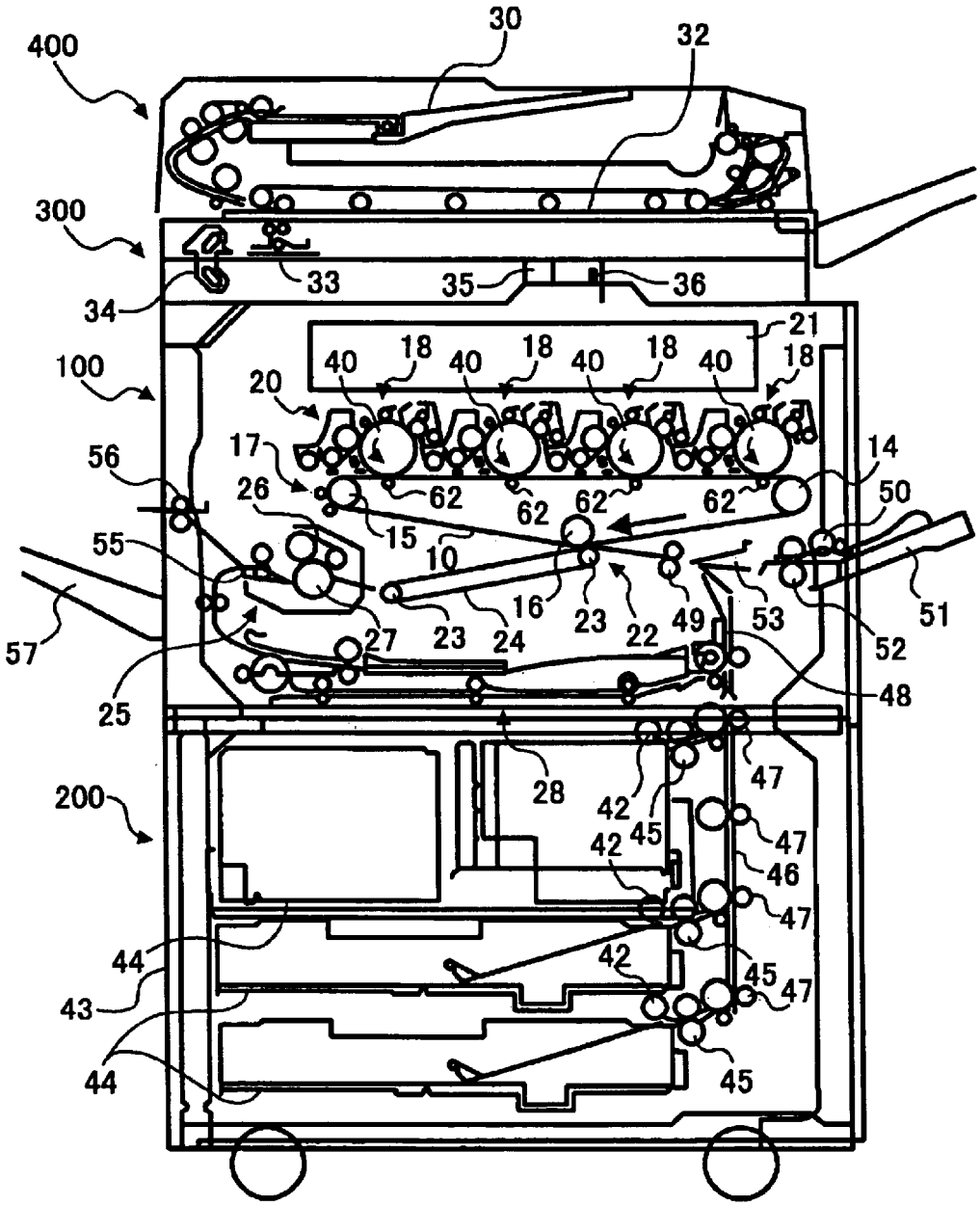
FIG. 17 shows another alternative embodiment of the present invention.

FIG. 17 shows another type of tandem color copier to which the belt drive control device is applicable. As shown, the color copier includes a frame or body 100, a sheet feed table 200 on which the frame 100 is mounted, a scanner 300 mounted on the frame 100, and an ADF (Automatic Document Feeder) mounted on the scanner 100.

An intermediate image transfer belt or endless belt (simply belt hereinafter) 10 is disposed in the frame 100 and passed over a first, a second and a third support roller 14, 15 and 16 to turn clockwise, as viewed in FIG. 17. In the specific configuration shown in FIG. 17, a cleaning device 17, assigned to the belt 10, is positioned at the left-hand side of the second support roller 15. Black, cyan, magenta and yellow image forming means 18 are arranged side by side along the belt 10 between the first and second support rollers 14 and 15, constituting a tandem image forming section 20.

An exposing device 21 is positioned above the tandem image forming section 20 while a secondary image transferring device 22 is positioned at the opposite side to the image forming section 20 with respect to the belt 10. The secondary image transferring device 22 includes a belt or secondary image transfer belt 24, which is an endless belt passed over two rollers 23. The belt 24 is pressed against the third support roller 16 via the belt 10, so that a full-color image can be transferred from the belt 10 to a sheet.

A fixing unit 25 is positioned beside the secondary image transferring device 22 and includes an endless fixing belt 26 and a press roller 27 pressed against the fixing belt 26.

The secondary image transferring device 22 additionally has a function of conveying the sheet, carrying a toner image thereon, to the fixing unit 25. While the secondary image transferring device 22 may be implemented as a non-contact type charger, the above conveying function is not available with a non-contact type charger.

A sheet turning device 28 is arranged below the secondary image transferring device 22 and fixing unit 25 in parallel to the tandem image forming section 20. In a duplex copy mode for forming images on both sides of a sheet, the sheet turning device 28 turns a sheet carrying an image on one side thereof.

In operation, the operator of the copier stacks desired documents on a document tray 30 included in the ADF 400 or opens the ADF 400, lays a document on a glass platen 32 included in the scanner 300, and again closes the ADF 400. Subsequently, when the operator presses a start switch not shown, the ADF 400 conveys one document to the glass platen 32, and then the scanner 300 is driven. On the other hand, when a document laid on the glass platen 32 by hand, the scanner 300 is immediately driven. In any case, in the scanner 300, a first carriage 33 in movement illuminates the document positioned on the glass platen 32 while the resulting imagewise reflection from th document is reflected toward a second carriage 34 also in movement. The second carriage 34 further reflects the incident light with a mirror toward an image sensor 36 via a lens 35.

In response to the operation of the start switch, a motor, not shown, drives one of the support rollers 14 through 16 for thereby causing the belt 10 to move. At this instant, the other support rollers are caused to rotate by the belt 10. At the same time, photoconductive drums, included in the four image forming means 18, are rotated to form a black, a yellow, a magenta and a cyan toner image thereon. Such toner images are sequentially transferred from the drums to the belt 10 one above the other, completing a full-color image.

A sheet bank 43 includes a stack of sheet cassettes 44 each being provided with a respective pickup roller 42 and a respective reverse roller 45. In response to the operation of the start switch, the pickup roller 42, assigned to designated one of the sheet cassettes 44, pays out a single sheet from the sheet cassette 44 while the reverse roller 45 separates the single sheet from the underlying sheets. The sheet thus paid out is conveyed by roller pairs 47 along a sheet feed path 46, which merges into a conveyance path 48 arranged in the frame 100. On the conveyance path 48, the sheet is once stopped by a registration roller pair 49. This is also true with a sheet fed from a manual feed tray 51 by a pickup roller 52 and a reverse roller 52 along a manual sheet feed path 53.

The registration roller pair 49 starts conveying the sheet at particular tang that allows the leading edge of the sheet to meet the leading edge of the full-color image formed on the belt 10. Subsequently, the full-color image is transferred from the belt 10 to the sheet by the secondary image transferring device 22.

The secondary image transferring device 22 conveys the sheet, carrying the full-color image thereon, to the fixing unit 25. After the fixing unit 25 has fixed the toner image on the sheet with heat and pressure, the sheet or copy is steered by a path selector 55 toward an outlet roller pair 56 and then driven out to a copy tray 57 by the outlet roller pair 56.

After the secondary image transfer, the cleaning device 17 removes toner left on the belt 10 to thereby prepare the belt 10 for the next image formation.

In the color copier shown in FIG. 17, the belt drive control device controls the drive of the belt 10 for thereby freeing the toner image formed on the belt 10 from irregular density and color shift.

In the configuration shown in FIG. 17, there may be constructed a belt conveyor device including the belt 10, the support rollers 14 through 16, an encoder associated with one support roller playing the role of a rotary driven body, a motor assigned to another support roller playing the role of a rotary drive body, and the belt driving device stated earlier. Further, the belt conveyor device may be constructed into a single process cartridge removably mounted to the apparatus of an image forming apparatus and therefore easy to maintain or replace.

As stated above, in the illustrative embodiment, from data representative of the variation of the angular displacement or the angular velocity of the driven roller 502 sensed by the encoder 601, the AC component of the angular velocity having a frequency corresponding to the periodic thickness variation of the belt 500 is separated. Subsequently, the rotation of the drive roller 501 is controlled in accordance with the amplitude and phase of the AC component. Therefore, the belt 500 can move at constant speed without being influenced by the thickness variation of the belt 500 in the circumferential direction. This can be done at low cost because it is not necessary to accurately measure the thickness of the belt 500 over the entire circumference or to use an expensive sensor for measuring the thickness of the belt 500 during control.

The driven roller whose angular displacement or angular velocity is to be sensed is not limited in position, so that design freedom relating to the arrangement of the support rollers is guaranteed. In addition, it is not necessary to provide a plurality of marks on the belt 500 at equal intervals in the circumferential direction for controlling the drive roller by sensing the running speed of the belt 500.

If desired, the DC component of the angular velocity of the driven roller 502 may be separated from the data representative of the variation of the angular displacement or the angular velocity of the driven roller 502 sensed by the encoder 601, in which case the rotation of the drive roller 501 will be controlled in accordance with the size of the DC component. With this control, it is possible to control the running speed of the belt 500 to preselected one in absolute value even when the driven roller 502 and drive roller 501 are different in radius from each other.

Also, the AC component of the angular velocity of the driven roller 502, which has a frequency other than the frequency corresponding to the periodic thickness variation, may be separated, in which case the rotation of the drive roller 501 will be controlled in accordance with the amplitude and phase of the above AC component. In this case, there can be obviated the variation of belt speed ascribable to a cause other than the thickness variation, e.g., the eccentricity of the drive roller or that of the drive transmission mechanism.

In the illustrative embodiment, if the drive roller 501 and driven roller 502 are different in radius from each other, then the relation between the amount of movement of the belt and the rotation angle and the timing at which the same portion of the belt 500 wraps differs from the drive side to the driven side. As a result, conditions for driving the belt 500 at constant speed vary from the drive side to the driven side.

In light of the above, it is preferable to process the AC signal by taking account of the radius $R_F$ of the driven roller 502, the effective belt thickness $\kappa B_{to}$ which is the reference for the speed of part of the belt 500 contacting the driven roller 502, the radius RD of the drive roller 501, the effective belt thickness $\beta B_{to}$ which is the reference for the speed of part of the belt 500 contacting the drive roller 501, and the period of time $\tau$ necessary for the belt 500 to move from the center of the portion where the belt 500 and driven roller 502 contact to the center of the portion where the belt 500 and drive roller 501 contact the rotation of the drive roller 501 is controlled in accordance with the amplitude and phase of the AC signal so processed. With such control, it is possible to drive the belt 500 at constant speed without regard to the thickness variation of the belt 500 while insuring design freedom as to the radiuses of the rollers 501 and 502 and the positional relation between the rollers 501 and 502.

Particularly, in the illustrative embodiment, to control the rotation of the drive roller 501, use may be made of a feedback signal including a signal that has a gain of $A^2/B^2$ relative to the AC component and is delayed by $(T-\tau)$ relative to the AC component. Here, A denotes the sum of the radius $R_E$ of the driven roller 502 and the effective belt thickness $\kappa B_{to}$ at the portion where the belt 500 and driven roller contact. Likewise, B denotes the sum of the radius $R_D$ of the driven roller 501 and the effective belt thickness $\beta B_{to}$ at the portion where the belt 500 and drive roller 501 contact. Also, $\tau$ denotes the period of time necessary for the belt 500 to move from the center of the portion where the belt 500 and driven roller 502 contact to the center of the portion where the belt 500 and drive roller 501 contact while T denotes the one-turn period of the belt 500. When use is made of a feedback signal or a target reference signal, taking account of the radiuses of the rollers and belt moving time $\tau$, the belt 500 can be accurately controlled even if the radiuses and positions of the rollers are freely designed.

In the illustrative embodiment, test drive may be executed with the belt 500 while varying the amplitude and phase of the reference signal ref used to control the rotation of the drive roller 501, in which case the amplitude and phase of the reference signal ref will be set such that a difference between the reference signal and the AC signal derived from the test drive becomes minimum. Subsequently, the rotation of the drive roller 501 is controlled in accordance with the result of comparison of the reference signal ref, which is so generated as to have the amplitude and phase set by the test drive, and AC component. This test drive scheme can optimize the reference signal ref without resorting to trial and error and therefore promotes rapid startup of the drive control device. Also, by effecting the test drive at adequate timing, it is possible to execute belt drive control little susceptible to aging and temperature variation. In addition, the belt drive control can be executed without resorting to a home sensor responsive to the home position of the belt 500.

In the illustrative embodiment, there may be executed test drive that causes the drive roller 501 at constant angular velocity by using a reference mark provided on the belt 500. In this case, information representative of the amplitude and phase of the AC signal appeared over at least the one-turn period of the thickness variation of the belt 500 during the test drive are stored. Subsequently, the rotation of the drive roller 501 is controlled in accordance with the result of sensing of th reference mark and the result of comparison of a reference signal based on the above information and AC component. The reference signal thus generated promotes easy control over the belt drive while causing a minimum of control errors to accumulate. In addition, belt drive control little susceptible to differences between individual belts or individual rollers is achievable.

In the illustrative embodiment, there may be separated a plurality of AC components corresponding to the periodic thickness variation of the belt 500 and different in frequency from each other. By controlling the rotation of the drive roller 501 on the basis of the plurality of AC components, it is possible to move the belt 500 at constant speed without regard to the thickness variation even when the thickness of the belt 500 has a complicated distribution.

In the illustrative embodiment, the drive roller 501 and driven roller 502 may have the same radius in order to simplify the calculation of the gain for generating the feedback signal. In this case, the distance by which th belt 500 moves from the center of the portion where the belt 500 and driven roller 502 contact to the center of the portion where the belt 500 and drive roller 501 contact may be an odd multiple of a length corresponding to one-half of the period of thickness variation. This makes it possible to generate the feedback signal without resorting to the delay circuit.

In the illustrative embodiment, when the drive roller 501 and driven roller 502 are different in radius, the above distance is selected to be an even multiple of the above length. This also makes the delay circuit unnecessary.

In the illustrative embodiment, when a plurality of driven rollers exist, the encoder 601 should preferably be mounted on the shaft of a drive roller little susceptible to the thickness variation ascribable to temperature. This protects the data representative of the angular displacement or the angular velocity of the driven roller 502 sensed by the encoder 601 from the influence of temperature.

In the illustrative embodiment, the belt drive control device may be applied to a photoconductive belt, an intermediate image transfer belt or a sheet conveying belt included in an image forming apparatus, so that such a belt can move at constant speed despite its thickness variation.

The apparatus can therefore produce high quality images free from irregular density and positional shift. Particularly, in the case of a color image forming apparatus, the belt drive control device obviates color shift. Further, in an image forming apparatus of the type transferring an image from an intermediate image transfer belt to a sheet being conveyed by a conveying belt, the drive control device may control the drive of the intermediate image transfer belt or the conveying belt so as to obviate expansion or contraction of an image ascribable to a difference in speed between the two belts.

Various modifications will become possible for those skilled in the art after receiving the teachings of the present disclosure without departing from the scope thereof.

What is claimed is:

1. A method of controlling drive of an endless belt by controlling rotation of, from among a plurality of rotary support bodies over which said endless belt is passed, a drive rotary support body to which drive torque is transferred, said method comprising:

(a) detecting an angular displacement or an angular velocity of a driven rotary support body, from among said plurality of rotary support bodies, not contributing to transfer of the drive torque;

(b) separating, from the angular displacement or the angular velocity detected, an AC (alternating current) component of the angular displacement or the angular velocity having a frequency that corresponds to a periodic thickness variation of said belt in a circumferential direction; and (c) controlling the rotation of said drive rotary support body in accordance with an amplitude and a phase of the AC component.

2. The method as claimed in claim 1, wherein the separating (b) comprises separating a plurality of AC components corresponding to the periodic variation of said belt and different in frequency from each other, and the controlling (c) comprises controlling the rotation of said drive rotary support body in accordance with the plurality of AC components.

3. The method as claimed in claim 1, further comprising:

(d) executing test drive that causes said drive rotary support body to rotate at a constant angular velocity by using a reference mark provided on said belt as a reference;

(e) storing information representative of the amplitude and the phase of the AC component appeared over at least one period of the thickness variation of said belt in the circumferential direction during the test drive;

(f) generating a target reference signal on the basis of a result of detection of the reference mark and the information stored; and (g) controlling the rotation of said drive rotary support body in accordance with a result of comparison of the target reference signal and the AC component.

4. The method as claimed in claim 3, wherein the separating (b) comprises separating a plurality of AC components corresponding to the periodic variation of said belt and different in frequency from each other, and the controlling (c) comprises controlling the rotation of said drive rotary support body in accordance with the plurality of AC components.

5. The method as claimed in claim 1, further comprising:

(d) executing test drive of said belt while varying an amplitude and a phase of a reference signal used to control the rotation of said drive rotary support body;

(e) setting the amplitude and the phase of the reference signal such that a difference between the AC component produced during the test drive and said reference signal becomes minimum; and (f) controlling the rotation of said drive rotary support body in accordance with a result of comparison or the reference signal, which is generated to have the amplitude and the phase set by the test drive, and the AC component.

6. The method as claimed in claim 5, wherein the separating (b) comprises separating a plurality of AC components corresponding to the periodic variation of said belt and different in frequency from each other, and the controlling (c) comprises controlling the rotation of said drive rotary support body in accordance with the plurality of AC components.

7. The method as claimed in claim 1, further comprising:

(d) processing the AC component by taking account of a radius of said driven rotary support body, an effective belt thickness which is a reference for a speed at which part of said belt contacting said driven rotary support body moves, a radius of said drive rotary support body, an effective belt thickness which is a reference for a speed at which part of said belt contacting said drive rotary support body moves, and a period of time necessary for said belt to move from a center of a portion where said belt and said driven rotary support body contact to a center of a portion where said belt and said drive rotary support body contact.

8. The method as claimed in claim 7, wherein the separating (b) comprises separating a plurality of AC components corresponding to the periodic variation of said belt and different in frequency from each other, and the controlling (c) comprises controlling the rotation of said drive rotary support body in accordance with the plurality of AC components.

9. The method as claimed in claim 7, further comprising:

(e) executing test drive that causes said drive rotary support body to rotate at a constant angular velocity by using a reference mark provided on said belt as a reference;

(f) storing information representative of the amplitude and the phase of the AC component appeared over at least one period of the thickness variation of said belt in the circumferential direction during the test drive;

(g) generating a target reference signal on the basis of a result of detection of the reference mark and the information stored; and (h) controlling the rotation of said drive rotary support body in accordance with a result of comparison of the target reference signal and the AC component.

10. The method as claimed in claim 9, wherein step the separating (b) comprises separating a plurality of AC components corresponding to the periodic variation of said belt and different in frequency from each other, and (c) the controlling comprises controlling the rotation of said drive rotary support body in accordance with the plurality of AC components.

11. The method as claimed in claim 7, further comprising:

(e) executing test drive of said belt while varying an amplitude and a phase of a reference signal used to control the rotation of said drive rotary support body;

(f) setting the amplitude and the phase of the reference signal such that a difference between the AC component produced during the test drive and said reference signal becomes minimum; and (g) controlling the rotation of said drive rotary support body in accordance with a result of comparison of the reference signal, which is generated to have the amplitude and the phase set by the test drive, and the AC component.

12. The method as claimed in claim 11, wherein the separating (b) comprises separating a plurality of AC components corresponding to the periodic variation of said belt and different in frequency from each other, and the controlling (c) comprises controlling the rotation of said drive rotary support body in accordance with the plurality of AC components.

13. A device for controlling drive of an endless belt by controlling rotation of, from among a plurality of rotary support bodies over which said endless belt is passed, a drive rotary support body to which drive torque is transferred, comprising:

control means for detecting an angular displacement or an angular velocity of a driven rotary support body, from among said plurality of rotary support bodies, not contributing to transfer of the drive torque, for separating, from said detected angular displacement or said angular velocity, an AC (alternating current) component of said angular displacement or said angular velocity having a frequency that corresponds to a periodic thickness variation of said endless belt in a circumferential direction, and for controlling the rotation of said drive rotary support body in accordance with an amplitude and a phase of said AC component.

14. The device as claimed in claim 13, wherein said control means is configured to separate a plurality of AC components corresponding to the periodic variation of said belt and different in frequency from each other and control the rotation of said drive rotary support body in accordance with said plurality of AC components.

15. The device as claimed in claim 13, wherein said control means is configured to execute test drive that causes said drive rotary support body to rotate at a constant angular velocity by using a reference mark provided on said belt as a reference, store information representative of the amplitude and the phase of the AC component appeared over at least one period of the thickness variation of said belt in the circumferential direction during said test drive, generate a target reference signal on the basis of a result of detection of said reference mark and said information stored, and control the rotation of said drive rotary support body in accordance with a result of comparison of said target reference signal and said AC component.

16. The device as claimed in claim 15, wherein said control means is configured to separate a plurality of AC components corresponding to the periodic variation of said belt and different in frequency from each other and control the rotation of said drive rotary support body in accordance with said plurality of AC components.

17. The device as claimed in claim 13, wherein said control means is configured to execute test drive of said belt while varying an amplitude and a phase of a reference signal used to control the rotation of said drive rotary support body, set the amplitude and the phase of the reference signal such that a difference between the AC component produced during said test drive and said reference signal becomes minimum, and control the rotation of said drive rotary support body in accordance with a result of comparison of said reference signal, which is generated to have the amplitude and the phase set by said test drive, and said AC component.

18. The device as claimed in claim 17, wherein said control means is configured to separate a plurality of AC components corresponding to the periodic variation of said belt and different in frequency from each other and control the rotation of said drive rotary support body in accordance with said plurality of AC components.

19. The device as claimed in claim 13, wherein said control means is configured to process the AC component by taking account of a radius of said driven rotary support body, an effective belt thickness which is a reference for a speed at which part of said belt contacting said driven rotary support body moves, a radius of said drive rotary support body, an effective belt thickness which is a reference for a speed at which part of said belt contacting said drive rotary support body moves, and a period of time necessary for said belt to move from a center of a portion where said belt and said driven rotary support body contact to a center of a portion where said belt and said drive rotary support body contact.

20. The device as claimed in claim 19, wherein said control means is configured to separate a plurality of AC components corresponding to the periodic variation of said belt and different in frequency from each other and control the rotation of said drive rotary support body in accordance with said plurality of AC components.

21. The device as claimed in claim 19, wherein said control means is configured to execute test drive that causes said drive rotary support body to rotate at a constant angular velocity by using a reference mark provided on said belt as a reference, store information representative of the amplitude and the phase of the AC component appeared over at least one period of the thickness variation of said belt in the circumferential direction during said test drive, generate a target reference signal on the basis of a result of detection of said reference mark and said information stored, and control the rotation of said drive rotary support body in accordance with a result of comparison of said target reference signal and said AC component.

22. The device as claimed in claim 21, wherein said control means is configured to separate a plurality of AC components corresponding to the periodic variation of said belt and different in frequency from each other and control the rotation of said drive rotary support body in accordance with said plurality of AC components.

23. The device as claimed in claim 19, wherein said control means is configured to execute test drive of said belt while varying an amplitude and a phase of a reference signal used to control the rotation of said drive rotary support body, set the amplitude and the phase of the reference signal such that a difference between the AC component produced during said test drive and said reference signal becomes minimum, and control the rotation of said drive rotary support body in accordance with a result of comparison of said reference signal, which is generated to have the amplitude and the phase set by said test drive, and said AC component.

24. The device as claimed in claim 23, wherein said control means is configured to separate a plurality of AC components corresponding to the periodic variation of said belt and different in frequency from each other and control the rotation of said drive rotary support body in accordance with said plurality of AC components.

25. A belt device comprising:

an endless belt passed over a plurality of rotary support bodies;

a drive source configured to output drive torque for driving said endless belt;

sensing means for sensing an angular displacement or an angular velocity of, from among said plurality of rotary support bodies, a driven rotary support body not contributing to transfer of the drive torque; and a belt drive control device configured to control, based on an output of said sensing means, rotation of a drive rotary support body, from among said plurality of rotary support bodies, to which the drive torque is transferred from said drive source, thereby controlling drive of said endless belt;

said belt drive control device comprising:

control means for separating, from the angular displacement or the angular velocity sensed by said sensing means, an AC (alternating current) component of said angular displacement or said angular velocity having a frequency that corresponds to a periodic thickness variation of said endless belt in a circumferential direction, and controlling the rotation of said drive rotary support body in accordance with an amplitude and a phase of said AC component.

26. The device as claimed in claim 25, wherein said drive rotary support body and said driven rotary support body have a same radius.

27. The device as claimed in claim 26, wherein a distance by which said belt moves from a center of a portion where said belt and said driven rotary support body contact to a center of a portion where said belt and said drive rotary support body contact is an odd multiple of a length corresponding to one-half of a period of the thickness variation of said belt in the circumferential direction.

28. The device as claimed in claim 25, wherein said drive rotary support body and said driven rotary support body are different in radius from each other, and a distance by which said belt moves from a center of a portion where said belt and said driven rotary support body contact to a center of a portion where said belt and said drive rotary support body contact is an even multiple of a length corresponding to one-half of a period of the thickness variation of said belt in the circumferential direction.

29. The device as claimed in claim 25, wherein said sensing means is mounted on one of a plurality of driven rotary support bodies located at a position little susceptible to the thickness variation ascribable to temperature.

30. The device as claimed in claim 25, wherein said belt comprises a photoconductive belt for use in an image forming apparatus.

31. The device as claimed in claim 25, wherein said belt comprises an intermediate image transfer belt for use in an image forming apparatus.

32. The device as claimed in claim 25, wherein said belt comprises a belt included in an image forming apparatus for conveying a recording medium to a position where an image is to be transferred from an image carrier to said recording medium.

33. The device as claimed in claim 25, wherein said belt comprises a belt included in an image forming apparatus for conveying a recording medium to a position where an image is to be transferred from an intermediate image transfer body to said recording medium.

34. An image forming apparatus comprising:

an image carrier comprising an endless belt passed over a plurality of rotary support bodies;

latent image forming means for forming a latent image on said image carrier;

developing means for developing the latent image to thereby produce a corresponding toner image;

image transferring means for transferring the toner image from said image carrier to a recording medium;

a drive source configured to output drive torque for driving said image carrier sensing means for sensing an angular displacement or an angular velocity of a driven rotary support body, from among said plurality of rotary support bodies, not contributing to transfer of the drive torque;

a belt drive control device configured to control, based on an output of said sensing means, rotation of a drive rotary support body, from among said plurality of rotary support bodies, to which the drive torque is transferred from said drive source, thereby controlling drive of said endless belt, said belt drive control device detecting an angular displacement or an angular velocity of a driven rotary support body, from among said plurality of rotary support bodies, not contributing to transfer of the drive torque, and separating, from said detected angular displacement or said angular velocity, an AC (alternating current) component of said angular displacement or said angular velocity having a frequency that corresponds to a periodic thickness variation of said endless belt in a circumferential direction; and control means for controlling the rotation of said drive rotary support body in accordance with an amplitude and a phase of the AC component.

35. The apparatus as claimed in claim 34, wherein said control means is configured to process the AC component by taking account of a radius of said driven rotary support body, an effective belt thickness which is a reference for a speed at which part of said belt contacting said driven rotary support body moves, a radius of said drive rotary support body, an effective belt thickness which is a reference for a speed at which part of said belt contacting said drive rotary support body moves, and a period of time necessary for said belt to move from a center of a portion where said belt and said driven rotary support body contact to a center of a portion where said belt and said drive rotary support body contact.

36. The apparatus as claimed in claim 34, wherein said control means is configured to execute test drive of said belt while varying an amplitude and a phase of a reference signal used to control the rotation of said drive rotary support body, set the amplitude and the phase of the reference signal such that a difference between the AC component produced during said test drive and said reference signal becomes minimum, and control the rotation of said drive rotary support body in accordance with a result of comparison of said reference signal, which is generated to have the amplitude and the phase set by said test drive, and said AC component.

37. The apparatus as claimed in claim 34, wherein said control means is configured to execute test drive that causes said drive rotary support body to rotate at a constant angular velocity by using a reference mark provided on said belt as a reference, store information representative of the amplitude and the phase of the AC component appeared over at least one period of the thickness variation of said belt in the circumferential direction during said test drive, generate a target reference signal on the basis of a result of detection of said reference mark and said information stored, and control the rotation of said drive rotary support body in accordance with a result of comparison of said target reference signal and said AC component.

38. The apparatus as claimed in claim 34, wherein said control means is configured to separate a plurality of AC components corresponding to the periodic variation of said belt and different in frequency from each other and control the rotation of said drive rotary support body in accordance with said plurality of AC components.

39. The apparatus as claimed in claim 34, wherein a process cartridge comprises at least the image carrier and the belt drive control device and is removably mounted to a body of said image forming apparatus.

40. An image forming apparatus comprising:

an image carrier;

latent image forming means for forming a latent image on said image carrier;

developing means for developing the latent image to thereby produce a corresponding toner image;

an intermediate image transfer body comprising an endless belt passed over a plurality of rotary support bodies;

first image transferring means for transferring the toner image from said image carrier to said intermediate image transfer body;

second image transferring means for transferring the toner image from said intermediate image transfer body to a recording medium;

a drive source configured to output drive torque for driving said intermediate image transfer body;

sensing means for sensing an angular displacement or an angular velocity of a driven rotary support body, from among said plurality of rotary support bodies, not contributing to transfer of the drive torque;

a belt drive control device configured to control, based on an output of said sensing means, rotation of a drive rotary support body, from among said plurality of rotary support bodies, to which the drive torque is transferred from said drive source, thereby controlling drive of said intermediate image transfer body, said belt drive control device detecting an angular displacement or an angular velocity of a driven rotary support body, from among said plurality of rotary support bodies, not contributing to transfer of the drive torque, and separating, from said detected angular displacement or said angular velocity an AC (alternating current) component of said angular displacement or said angular velocity having a frequency that corresponds to a periodic thickness variation of said intermediate image transfer body in a circumferential direction; and control means for controlling the rotation of said drive rotary support body in accordance with an amplitude and a phase of said AC component.

41. The apparatus as claimed in claim 40, wherein said control means is configured to process the AC component by taking account of a radius of said driven rotary support body, an effective belt thickness which is a reference for a speed at which part of said belt contacting said driven rotary support body moves, a radius of said drive rotary support body, an effective belt thickness which is a reference for a speed at which part of said belt contacting said drive rotary support body moves, and a period of time necessary for said belt to move from a center of a portion where said belt and said driven rotary support body contact to a center of a portion where said belt and said drive rotary support body contact.

42. The apparatus as claimed in claim 40, wherein said control means is configured to execute test drive of said belt while varying an amplitude and a phase of a reference signal used to control the rotation of said drive rotary support body, set the amplitude and the phase of the reference signal such that a difference between the AC component produced during said test drive and said reference signal becomes minimum, and control the rotation of said drive rotary support body in accordance with a result of comparison of said reference signal, which is generated to have the amplitude and the phase set by said test drive, and said AC component.

43. The apparatus as claimed in claim 40 wherein said control means is configured to execute test drive that causes said drive rotary support body to rotate at a constant angular velocity by using a reference mark provided on said belt as a reference, store information representative of the amplitude and the phase of the AC component appeared over at least one period of the thickness variation of said belt in the circumferential direction during said test drive, generate a target reference signal on the basis of a result of detection of said reference mark and said information stored, and control the rotation of said drive rotary support body in accordance with a result of comparison of said target reference signal and said AC component.

44. The apparatus as claimed in claim 40, wherein said control means is configured to separate a plurality of AC components corresponding to the periodic variation of said belt and different in frequency from each other and control the rotation of said drive rotary support body in accordance with said plurality of AC components.

45. An image forming apparatus comprising:

an image carrier;

latent image forming means for forming a latent image on said image carrier;

developing means for developing the latent image to thereby produce a corresponding toner image;

a conveying member comprising an endless belt, which is passed over a plurality of rotary support bodies, for conveying a recording medium;

image transferring means for transferring the toner image from said image carrier to the recording medium, which is being conveyed by said conveying member, with or without intermediary of an intermediate image transfer body;

a drive source configured to output drive torque for driving said conveying member;

sensing means for sensing an angular displacement or an angular velocity of a driven rotary support body, from among said plurality of rotary support bodies, not contributing to transfer of the drive torque;

a belt drive control device configured to control, based on an output of said sensing means, rotation of a drive rotary support body, from among said plurality of rotary support bodies, to which the drive torque is transferred from said drive source, thereby controlling drive of said conveying member, said belt drive control device detecting an angular displacement or an angular velocity of a driven rotary support body, from among said plurality of rotary support bodies, not contributing to transfer of the drive torque, and separating, from said detected angular displacement or said angular velocity an AC (alternating current) component of said angular displacement or said angular velocity having a frequency that corresponds to a periodic thickness variation of said conveying member in a circumferential direction; and control means for controlling the rotation of said drive rotary support body in accordance with an amplitude and a phase of said AC component.

46. The apparatus as claimed in claim 45, wherein said control means is configured to process the AC component by taking account of a radius of said driven rotary support body, an effective belt thickness which is a reference for a speed at which part of said belt contacting said driven rotary support body moves, a radius of said drive rotary support body, an effective belt thickness which is a reference for a speed at which part of said belt contacting said drive rotary support body moves, and a period of time necessary for said belt to move from a center of a portion where said belt and said driven rotary support body contact to a center of a portion where said belt and said drive rotary support body contact.

47. The apparatus as claimed in claims 45, wherein said control means is configured to execute test drive of said belt while varying an amplitude and a phase of a reference signal used to control the rotation of said drive rotary support body, set the amplitude and the phase of the reference signal such that a difference between the AC component produced during said test drive and said reference signal becomes minimum, and control the rotation of said drive rotary support body in accordance with a result of comparison of said reference signal, which is generated to have the amplitude and the phase set by said test drive, and said AC component.

48. The apparatus as claimed in claim 45, wherein said control means is configured to execute test drive that causes said drive rotary support body to rotate at a constant angular velocity by using a reference mark provided on said belt as a reference, store information representative of the amplitude and the phase of the AC component appeared over at least one period of the thickness variation of said belt in the circumferential direction during said test drive, generate a target reference signal on the basis of a result of detection of said reference mark and said information stored, and control the rotation of said drive rotary support body in accordance with a result of comparison of said target reference signal and said AC component.

49. The apparatus as claimed in claim 45, wherein said control means is configured to separate a plurality of AC components corresponding to the periodic variation of said belt and different in frequency from each other and control the rotation of said drive rotary support body in accordance with said plurality of AC components.

50. A program for controlling drive of an endless belt by controlling rotation of, from among a plurality of rotary support bodies over which said endless belt is passed, a drive rotary support body to which drive torque is transferred, comprising: separating, from data representative of an angular displacement or an angular velocity of a driven rotary support body, from among said plurality of rotary support bodies, not contributing to transfer of said drive torque, an AC (alternating current) component of said angular displacement or said angular velocity having a frequency that corresponds to a periodic thickness variation of said endless belt in a circumferential direction and controlling rotation of said drive rotary support body in accordance with an amplitude and a phase of said AC component are executed by a computer.

51. The program as claimed in claim 50, wherein the processing the AC component is executed by the computer in consideration of a radius of said driven rotary support body, an effective belt thickness which is a reference for a speed at which part of said belt contacting said driven rotary support body moves, a radius of said drive rotary support body, an effective belt thickness which is a reference for a speed at which part of said belt contacting said drive rotary support body moves, and a period of time necessary for said belt to move from a center of a portion where said belt and said driven rotary support body contact to a center of a portion where said belt and said drive rotary support body contact.

52. The program as claimed in claim 50, wherein executing test drive of said belt while varying an amplitude and a phase of a reference signal used to control the rotation of said drive rotary support body and setting the amplitude and the phase of the reference signal such that a difference between the AC component produced during said test drive and said reference signal becomes minimum is executed by the computer, and the rotation of said drive rotary support body is controlled in accordance with a result of comparison of said reference signal, which is generated to have the amplitude and the phase set by said test drive, and said AC component.

53. The program as claimed in claim 50, wherein executing test drive that causes said drive rotary support body to rotate at a constant angular velocity by using a reference mark provided on said belt as a reference and storing information representative of the amplitude and the phase of the AC component appeared over at least one period of the thickness variation of said belt in the circumferential direction during said test drive and a step of generating a target reference signal on the basis of a result of detection of said reference mark and said information stored is executed by the computer, and the rotation of said drive rotary support body is controlled in accordance with a result of comparison of said target reference signal and said AC component.

54. The program as claimed in claim 50, wherein a plurality of AC components corresponding to the periodic variation of said belt and different in frequency from each other are separated, and the rotation of said drive rotary support body is controlled in accordance with said plurality of AC components.

55. A recording medium storing a program for controlling drive of an endless belt by controlling rotation of from among a plurality of rotary support bodies over which said endless belt is passed, a drive rotary support body to which drive torque is transferred, said program causing a computer to execute separating, from data representative of an angular displacement or an angular velocity of, a driven rotary support body, from among said plurality of rotary support bodies, not contributing to transfer of said drive torque, an AC (alternating current) component of said angular displacement or said angular velocity having a frequency that corresponds to a periodic thickness variation of said endless belt in a circumferential direction and controlling rotation of said drive rotary support body in accordance with an amplitude and a phase of said AC component are executed.

56. A device for controlling drive of an endless belt by controlling rotation of, from among a plurality of rotary support bodies over which said endless belt is passed, a drive rotary support body to which drive torque is transferred, comprising:

a controller configured to detect an angular displacement or an angular velocity of a driven rotary support body, from among said plurality of rotary support bodies, not contributing to transfer of the drive torque, to separate, from said detected angular displacement or said angular velocity, an AC (alternating current) component of said angular displacement or said angular velocity having a frequency that corresponds to a periodic thickness variation of said endless belt in a circumferential direction, and to control the rotation of said drive rotary support body in accordance with an amplitude and a phase of said AC component.

57. The device as claimed in claim 56, wherein said controller is configured to separate a plurality of AC components corresponding to the periodic variation of said belt and different in frequency from each other and control the rotation of said drive rotary support body in accordance with said plurality of AC components.

58. The apparatus as claimed in claim 57, wherein said controller is configured to execute test drive of said belt while varying an amplitude and a phase of a reference signal used to control the rotation of said drive rotary support body, set the amplitude and the phase of the reference signal such that a difference between the AC component produced during said test drive and said reference signal becomes minimum, and control the rotation of said drive rotary support body in accordance with a result of comparison of said reference signal, which is generated to have the amplitude and the phase set by said test drive, and said AC component.

59. The device as claimed in claim 56, wherein said controller is configured to execute test drive that causes said drive rotary support body to rotate at a constant angular velocity by using a reference mark provided on said belt as a reference, store information representative of the amplitude and the phase of the AC component appeared over at least one period of the thickness variation of said belt in the circumferential direction during said test drive, generate a target reference signal on the basis of a result of detection of said reference mark and said information stored, and control the rotation of said drive rotary support body in accordance with a result of comparison of said target reference signal and said AC component.

60. The device as claimed in claim 59, wherein said controller is configured to separate a plurality of AC components corresponding to the periodic variation of said belt and different in frequency from each other and control the rotation of said drive rotary support body in accordance with said plurality of AC components.

61. The device as claimed in claim 56, wherein said controller is configured to execute test drive of said belt while varying an amplitude and a phase of a reference signal used to control the rotation of said drive rotary support body, set the amplitude and the phase of the reference signal such that a difference between the AC component produced during said test drive and said reference signal becomes minimum, and control the rotation of said drive rotary support body in accordance with a result of comparison of said reference signal, which is generated to have the amplitude and the phase set by said test drive, and said AC component.

62. The device as claimed in claim 61, wherein said controller is configured to separate a plurality of AC components corresponding to the periodic variation of said belt and different in frequency from each other and control the rotation of said drive rotary support body in accordance with said plurality of AC components.

63. The device as claimed in claim 56, wherein said controller is configured to process the AC component by taking account of a radius of said driven rotary support body, an effective belt thickness which is a reference for a speed at which part of said belt contacting said driven rotary support body moves, a radius of said drive rotary support body, an effective belt thickness which is a reference for a speed at which part of said belt contacting said drive rotary support body moves, and a period of time necessary for said belt to move from a center of a portion where said belt and said driven rotary support body contact to a center of a portion where said belt and said drive rotary support body contact.

64. The device as claimed in claim 63, wherein said controller is configured to separate a plurality of AC components corresponding to the periodic variation of said belt and different in frequency from each other and control the rotation of said drive rotary support body in accordance with said plurality of AC components.

65. The device as claimed in claim 63, wherein said controller is configured to execute test drive that causes said drive rotary support body to rotate at a constant angular velocity by using a reference mark provided on said belt as a reference, store information representative of the amplitude and the phase of the AC component appeared over at least one period of the thickness variation of said belt in the circumferential direction during said test drive, generate a target reference signal on the basis of a result of detection of said reference mark and said information stored, and control the rotation of said drive rotary support body in accordance with a result of comparison of said target reference signal and said AC component.

66. The device as claimed in claim 65, wherein said controller is configured to separate a plurality of AC components corresponding to the periodic variation of said belt and different in frequency from each other and control the rotation of said drive rotary support body in accordance with said plurality of AC components.

67. The device as claimed in claim 63, wherein said controller is configured to execute test drive of said belt while varying an amplitude and a phase of a reference signal used to control the rotation of said drive rotary support body, set the amplitude and the phase of the reference signal such that a difference between the AC component produced during said test drive and said reference signal becomes minimum, and control the rotation of said drive rotary support body in accordance with a result of comparison of said reference signal, which is generated to have the amplitude and the phase set by said test drive, and said AC component.

68. The device as claimed in claim 67, wherein said controller is configured to separate a plurality of AC components corresponding to the periodic variation of said belt and different in frequency from each other and control the rotation of said drive rotary support body in accordance with said plurality of AC components.

69. A belt device comprising:

an endless belt passed over a plurality of rotary support bodies;

a drive source configured to output drive torque for driving said endless belt;

a sensor configured to sense an angular displacement or an angular velocity of, from among said plurality of rotary support bodies, a driven rotary support body not contributing to transfer of the drive torque; and a belt drive control device configured to control, based on an output of said sensor rotation of a drive rotary support body, from among said plurality of rotary support bodies, to which the drive torque is transferred from said drive source, thereby controlling drive of said endless belt;

said belt drive control device comprising:

a controller configured to separate, from the angular displacement or the angular velocity sensed by said sensor, an AC (alternating current) component of said angular displacement or said angular velocity having a frequency that corresponds to a periodic thickness variation of said endless belt in a circumferential direction, and to control the rotation of said drive rotary support body in accordance with an amplitude and a phase of said AC component.

70. The device as claimed in claim 69, wherein said drive rotary support body and said driven rotary support body have a same radius.

71. The device as claimed in claim 70, wherein a distance by which said belt moves from a center of a portion where said belt and said driven rotary support body contact to a center of a portion where said belt and said drive rotary support body contact is an odd multiple of a length corresponding to one-half of a period of the thickness variation of said belt in the circumferential direction.

72. The device as claimed in claim 69, wherein said drive rotary support body and said driven rotary support body are different in radius from each other, and a distance by which said belt moves from a center of a portion where said belt and said driven rotary support body contact to a center of a portion where said belt and said drive rotary support body contact is an even multiple of a length corresponding to one-half of a period of the thickness variation of said belt in the circumferential direction.

73. The device as claimed in claim 69, wherein said sensor is mounted on one of a plurality of driven rotary support bodies located at a position little susceptible to the thickness variation ascribable to temperature.

74. The device as claimed in claim 69, wherein said belt comprises a photoconductive belt for use in an image forming apparatus.

75. The device as claimed in claim 69, wherein said belt comprises an intermediate image transfer belt for use in an image forming apparatus.

76. The device as claimed in claim 69, wherein said belt comprises a belt included in an image forming apparatus for conveying a recording medium to a position where an image is to be transferred from an image carrier to said recording medium.

77. The device as claimed in claim 69, wherein said belt comprises a belt included in an image forming apparatus for conveying a recording medium to a position where an image is to be transferred from an intermediate image transfer body to said recording medium.

78. An image forming apparatus comprising:

an image carrier comprising an endless belt passed over a plurality of rotary support bodies;

a latent image forming device configured to form a latent image on said image carrier;

a developer configured to develop the latent image to thereby produce a corresponding toner image;

an image transfer device configured to transfer the toner image from said image carrier to a recording medium;

a drive source configured to output drive torque for driving said image carrier;

a sensor configured to sense an angular displacement or an angular velocity of a driven rotary support body, from among said plurality of rotary support bodies, not contributing to transfer of the drive torque;

a belt drive control device configured to control, based on an output of said sensor, rotation of a drive rotary support body, from among said plurality of rotary support bodies, to which the drive torque is transferred from said drive source, thereby controlling drive of said endless belt, said belt drive control device detecting an angular displacement or an angular velocity of a driven rotary support body, from among said plurality of rotary support bodies, not contributing to transfer of the drive torque, and separating, from said detected angular displacement or said angular velocity, an AC (alternating current) component of said angular displacement or said angular velocity having a frequency that corresponds to a periodic thickness variation of said endless belt in a circumferential direction; and a controller configured to control the rotation of said drive rotary support body in accordance with an amplitude and a phase of the AC component.

79. The apparatus as claimed in claim 78, wherein said controller is configured to process the AC component by taking account of a radius of said driven rotary support body, an effective belt thickness which is a reference for a speed at which part of said belt contacting said driven rotary support body moves, a radius of said drive rotary support body, an effective belt thickness which is a reference for a speed at which part of said belt contacting said drive rotary support body moves, and a period of time necessary for said belt to move from a center of a portion where said belt and said driven rotary support body contact to a center of a portion where said belt and said drive rotary support body contact.

80. The apparatus as claimed in claim 78, wherein said controller is configured to execute test drive of said belt while varying an amplitude and a phase of a reference signal used to control the rotation of said drive rotary support body, set the amplitude and the phase of the reference signal such that a difference between the AC component produced during said test drive and said reference signal becomes minimum, and control the rotation of said drive rotary support body in accordance with a result of comparison of said reference signal, which is generated to have the amplitude and the phase set by said test drive, and said AC component.

81. The apparatus as claimed in claim 78, wherein said controller is configured to execute test drive that causes said drive rotary support body to rotate at a constant angular velocity by using a reference mark provided on said belt as a reference, store information representative of the amplitude and the phase of the AC component appeared over at least one period of the thickness variation of said belt in the circumferential direction during said test drive, generate a target reference signal on the basis of a result of detection of said reference mark and said information stored, and control the rotation of said drive rotary support body in accordance with a result of comparison of said target reference signal and said AC component.

82. The apparatus as claimed in claim 78, wherein said controller is configured to separate a plurality of AC components corresponding to the periodic variation of said belt and different in frequency from each other and control the rotation of said drive rotary support body in accordance with said plurality of AC components.

83. The apparatus as claimed in claim 78, wherein a process cartridge comprises at least the image carrier and the belt drive control device and is removably mounted to a body of said image forming apparatus.

84. An image forming apparatus comprising:

an image carrier;

a latent image forming device configured to form a latent image on said image carrier;

a developer configured to develop the latent image to thereby produce a corresponding toner image;

an intermediate image transfer body comprising an endless belt passed over a plurality of rotary support bodies;

a first image transfer device configured to transfer the toner image from said image carrier to said intermediate image transfer body;

a second image transfer device configured to transfer the toner image from said intermediate image transfer body to a recording medium;

a drive source configured to output drive torque for driving said intermediate image transfer body;

a sensor configured to sense an angular displacement or an angular velocity of a driven rotary support body, from among said plurality of rotary support bodies, not contributing to transfer of the drive torque;

a belt drive control device configured to control, based on an output of said sensor, rotation of a drive rotary support body, from among said plurality of rotary support bodies, to which the drive torque is transferred from said drive source, thereby controlling drive of said intermediate image transfer body, said belt drive control device detecting an angular displacement or an angular velocity of a driven rotary support body, from among said plurality of rotary support bodies, not contributing to transfer of the drive torque, and separating, from said detected angular displacement or said angular velocity, an AC (alternating current) component of said angular displacement or said angular velocity having a frequency that corresponds to a periodic thickness variation of said intermediate image transfer body in a circumferential direction; and a controller configured to control the rotation of said drive rotary support body in accordance with an amplitude and a phase of said AC component.

85. The apparatus as claimed in claim 84, wherein said controller is configured to process the AC component by taking account of a radius of said driven rotary support body, an effective belt thickness which is a reference for a speed at which part of said belt contacting said driven rotary support body moves, a radius of said drive rotary support body, an effective belt thickness which is a reference for a speed at which part of said belt contacting said drive rotary support body moves, and a period of time necessary for said belt to move from a center of a portion where said belt and said driven rotary support body contact to a center of a portion where said belt and said drive rotary support body contact.

86. The apparatus as claimed in claim 84, wherein said controller is configured to execute test drive of said belt while varying an amplitude and a phase of a reference signal used to control the rotation of said drive rotary support body, set the amplitude and the phase of the reference signal such that a difference between the AC component produced during said test drive and said reference signal becomes minimum, and control the rotation of said drive rotary support body in accordance with a result of comparison of said reference signal, which is generated to have the amplitude and the phase set by said test drive, and said AC component.

87. The apparatus as claimed in claim 84, wherein said controller is configured to execute test drive that causes said drive rotary support body to rotate at a constant angular velocity by using a reference mark provided on said belt as a reference, store information representative of the amplitude and the phase of the AC component appeared over at least one period of the thickness variation of said belt in the circumferential direction during said test drive, generate a target reference signal on the basis of a result of detection of said reference mark and said information stored, and control the rotation of said drive rotary support body in accordance with a result of comparison of said target reference signal and said AC component.

88. The apparatus as claimed in claim 84, wherein said controller is configured to separate a plurality of AC components corresponding to the periodic variation of said belt and different in frequency from each other and control the rotation of said drive rotary support body in accordance with said plurality of AC components.

89. An image forming apparatus comprising:

an image carrier;

a latent image forming device configured to form a latent image on said image carrier;

a developer configured to develop the latent image to thereby produce a corresponding toner image;

a conveying member comprising an endless belt, which is passed over a plurality of rotary support bodies, for conveying a recording medium;

an image transfer device configured to transfer the toner image from said image carrier to the recording medium, which is being conveyed by said conveying member, with or without intermediary of an intermediate image transfer body;

a drive source configured to output drive torque for driving said conveying member;

a sensor configured to sense an angular displacement or an angular velocity of a driven rotary support body, from among said plurality of rotary support bodies, not contributing to transfer of the drive torque;

a belt drive control device configured to control, based on an output of said sensor, rotation of a drive rotary support body, from among said plurality of rotary support bodies, to which the drive torque is transferred from said drive source, thereby controlling drive of said conveying member, said belt drive control device detecting an angular displacement or an angular velocity of a driven rotary support body, from among said plurality of rotary support bodies, not contributing to transfer of the drive torque, and separating, from said detected angular displacement or said angular velocity, an AC (alternating current) component of said angular displacement or said angular velocity having a frequency that corresponds to a periodic thickness variation of said conveying member in a circumferential direction; and a controller configured to control the rotation of said drive rotary support body in accordance with an amplitude and a phase of said AC component.

90. The apparatus as claimed in claim 89, wherein said controller is configured to process the AC component by taking account of a radius of said driven rotary support body, an effective belt thickness which is a reference for a speed at which part of said belt contacting said driven rotary support body moves, a radius of said drive rotary support body, an effective belt thickness which is a reference for a speed at which part of said belt contacting said drive rotary support body moves, and a period of time necessary for said belt to move from a center of a portion where said belt and said driven rotary support body contact to a center of a portion where said belt and said drive rotary support body contact.

91. The apparatus as claimed in claim 89, wherein said controller is configured to execute test drive that causes said drive rotary support body to rotate at a constant angular velocity by using a reference mark provided on said belt as a reference, store information representative of the amplitude and the phase of the AC component appeared over at least one period of the thickness variation of said belt in the circumferential direction during said test drive, generate a target reference signal on the basis of a result of detection of said reference mark and said information stored, and control the rotation of said drive rotary support body in accordance with a result of comparison of said target reference signal and said AC component.

92. The apparatus as claimed in claim 89, wherein said controller is configured to separate a plurality of AC components corresponding to the periodic variation of said belt and different in frequency from each other and control the rotation of said drive rotary support body in accordance with said plurality of AC components.

* * * * *